US011435683B2

(12) United States Patent
Nanno

(10) Patent No.: US 11,435,683 B2
(45) Date of Patent: Sep. 6, 2022

(54) HEATING DEVICE, FIXING DEVICE, AND IMAGE FORMING APPARATUS

(71) Applicant: Shigeo Nanno, Kanagawa (JP)

(72) Inventor: Shigeo Nanno, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/382,383

(22) Filed: Jul. 22, 2021

(65) Prior Publication Data

US 2022/0035287 A1 Feb. 3, 2022

(30) Foreign Application Priority Data

Jul. 29, 2020 (JP) ..... JP2020-128405

(51) Int. Cl.
*G03G 15/20* (2006.01)
*G03G 15/23* (2006.01)

(52) U.S. Cl.
CPC ..... *G03G 15/2064* (2013.01); *G03G 15/2039* (2013.01); *G03G 15/231* (2013.01)

(58) Field of Classification Search
CPC ..... G03G 15/2064; G03G 15/2042; G03G 15/2039; G03G 21/1633; G03G 2221/1639
See application file for complete search history.

(56) References Cited

U.S. PATENT DOCUMENTS

2006/0086727 A1* 4/2006 Takematsu ..... G03G 15/2042 219/619
2013/0094887 A1* 4/2013 Nawa ..... G03G 15/2053 399/330
2014/0153966 A1* 6/2014 Tanaka ..... G03G 15/2028 399/323
2018/0004134 A1* 1/2018 Nomura ..... G03G 15/2017
2018/0157003 A1* 6/2018 Tsuchihashi ..... G03G 15/2042
2019/0025739 A1* 1/2019 Izawa ..... G03G 15/2039
2019/0163103 A1* 5/2019 Iizuka ..... G03G 21/1671
2020/0033771 A1 1/2020 Furuichi et al.
2020/0103799 A1 4/2020 Adachi et al.
2020/0174408 A1 6/2020 Furuichi et al.
2020/0183307 A1 6/2020 Furuichi et al.
2021/0389692 A1* 12/2021 Oguni ..... G03G 15/0886

FOREIGN PATENT DOCUMENTS

JP 2013-007777 1/2013
JP 2013068773 4/2013
JP 2013109014 A * 6/2013
JP 2017-215385 12/2017

* cited by examiner

*Primary Examiner* — Sevan A Aydin
(74) *Attorney, Agent, or Firm* — Xsensus LLP

(57) ABSTRACT

A heating device includes a heating rotator, a pressing rotator, and a housing. The heating rotator extends in a longitudinal direction and is configured to heat a sheet. The pressing rotator extends in a longitudinal direction and is configured to press against the heating rotator to form a nip with the heating rotator. The housing houses the heating rotator and the pressing rotator. The housing includes a pair of openings and shutters. The pair of openings face both end portions of the heating rotator in the longitudinal direction of the heating rotator. The shutters are configured to rotate about an axis extending in the longitudinal direction of the heating rotator to open and close the pair of openings.

11 Claims, 14 Drawing Sheets

HEATING DEVICE, FIXING DEVICE, AND IMAGE FORMING APPARATUS

CROSS-REFERENCE TO RELATED APPLICATION

This patent application is based on and claims priority pursuant to 35 U.S.C. § 119(a) to Japanese Patent Applications No. 2020-128405, filed on Jul. 29, 2020 in the Japan Patent Office, the entire disclosure of each of which is hereby incorporated by reference herein.

BACKGROUND

Technical Field

Embodiments of the present disclosure relate to a heating device, a fixing device, and an image forming apparatus, and more particularly to a heating device including a cooling device to cool a part of the heating device, and a fixing device and an image forming apparatus including the heating device.

Related Art

Various types of fixing devices used in an electrophotographic image forming apparatus are known, and one of the types is a surf fixing system that is excellent in energy saving performance and short in warm-up time. In the surf fixing method, a thin fixing belt having a low heat capacity is contact-heated from the inside by a planar heater, a sheet passing through a fixing nip is heated by the fixing belt, and an unfixed toner image borne on the sheet is fixed under heat.

When small-sized sheets are continuously printed by such a fixing device, the temperature of the longitudinal end portions (non sheet-passing portions) of the fixing belt may rise excessively. The excessive rise in the temperatures of the end portions deteriorates the durability of the fixing belt. Additionally, with the excessive rise in the temperatures of the end portions, when the printing of the small-sized sheet is shifted to the printing of the large-sized sheet, the supply amount of fixing heat at the end portions becomes excessive (high temperature). Problems such as an offset and a jam due to sheet winding around the fixing belt may occur.

SUMMARY

This specification describes an improved heating device that includes a heating rotator, a pressing rotator, and a housing. The heating rotator extends in a longitudinal direction and is configured to heat a sheet. The pressing rotator extends in a longitudinal direction and is configured to press against the heating rotator to form a nip with the heating rotator. The housing houses the heating rotator and the pressing rotator. The housing includes a pair of openings and shutters. The pair of openings face both end portions of the heating rotator in the longitudinal direction of the heating rotator. The shutters are configured to rotate about an axis extending in the longitudinal direction of the heating rotator to open and close the pair of openings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1A:
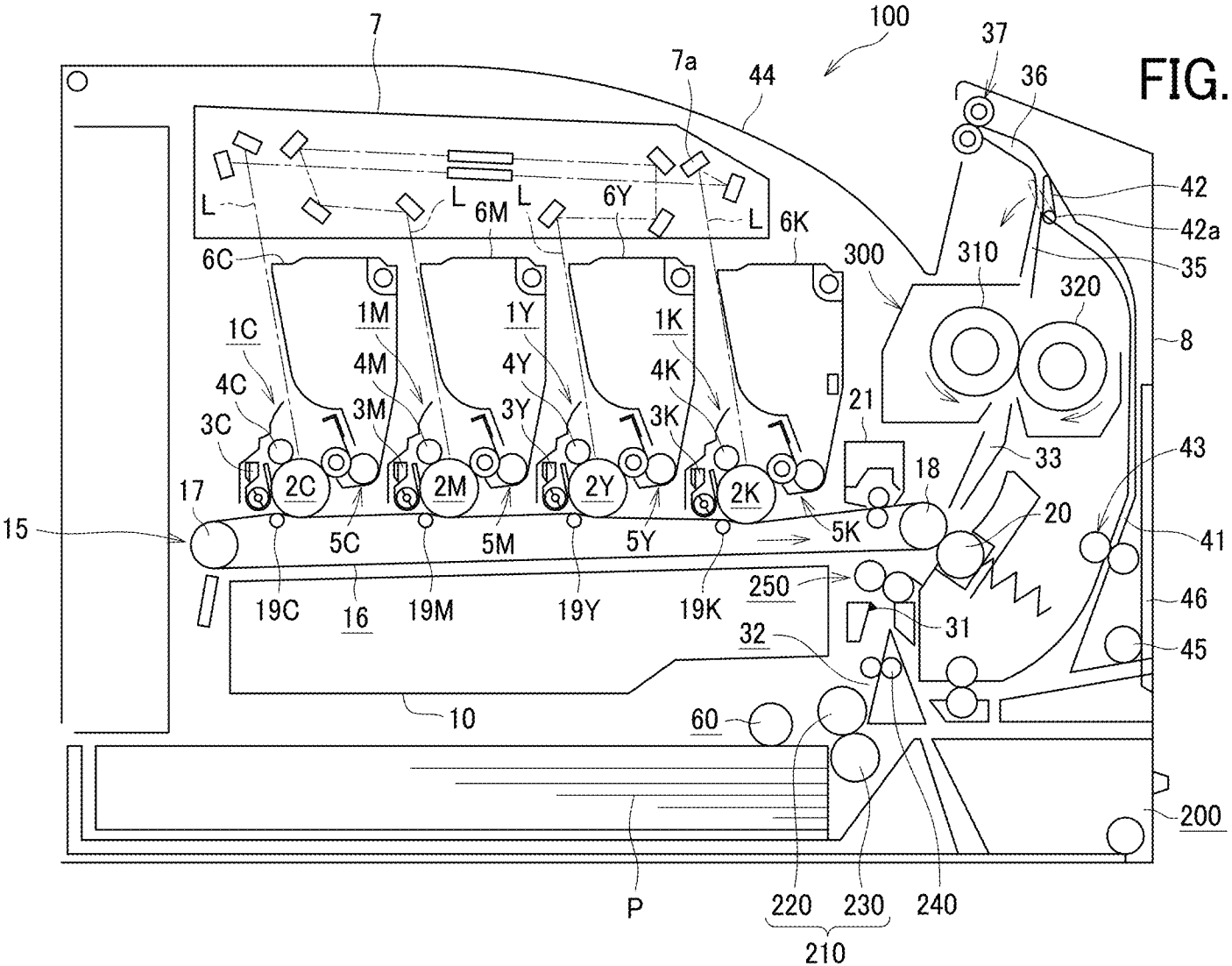
FIG. 1A is a schematic view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Referring now to the drawings, embodiments of the present disclosure are described below. As used herein, the singular forms "a," "an," and "the" are intended to include the plural forms as well, unless the context clearly indicates otherwise.

With reference to drawings, a description is given of a fixing device according to an embodiment of the present disclosure and an image forming apparatus such as a laser printer using the fixing device. The laser printer is just an example of the image forming apparatus, and thus the image forming apparatus is not limited to the laser printer. In other words, the image forming apparatus may be a copier, a facsimile machine, a printer, a plotter, an inkjet recording apparatus, or a multifunction peripheral having at least two of copying, printing, facsimile transmission, plotting, scanning, and inkjet recording capabilities.

The identical or similar parts in each drawing are designated by the same reference numerals, and the duplicate description thereof is appropriately simplified or omitted. Further, size (dimension), material, shape, and relative positions used to describe each of the components and units are examples, and the scope of the present disclosure is not limited thereto unless otherwise specified.

Although a "recording medium" is described as a "sheet of paper" (simply referred to as "sheet") in the following embodiments, the "recording medium" is not limited to the sheet of paper. Examples of the "recording medium" include not only the sheet of paper but also an overhead projector (OHP) transparency sheet, a fabric, a metallic sheet, a plastic film, and a prepreg sheet including carbon fibers previously impregnated with resin.

Examples of the "recording medium" include all media to which developer or ink can be adhered, and so-called recording paper and recording sheets. Examples of the "sheet" include thick paper, a postcard, an envelope, thin paper, coated paper (e.g., coat paper and art paper), and tracing paper, in addition to plain paper.

The term "image formation" used in the following description means not only giving an image such as a character or a figure to a medium but also giving an arbitrary image such as a pattern to the medium.

A configuration of the image forming apparatus according to an embodiment is described below.

Figure 1B:
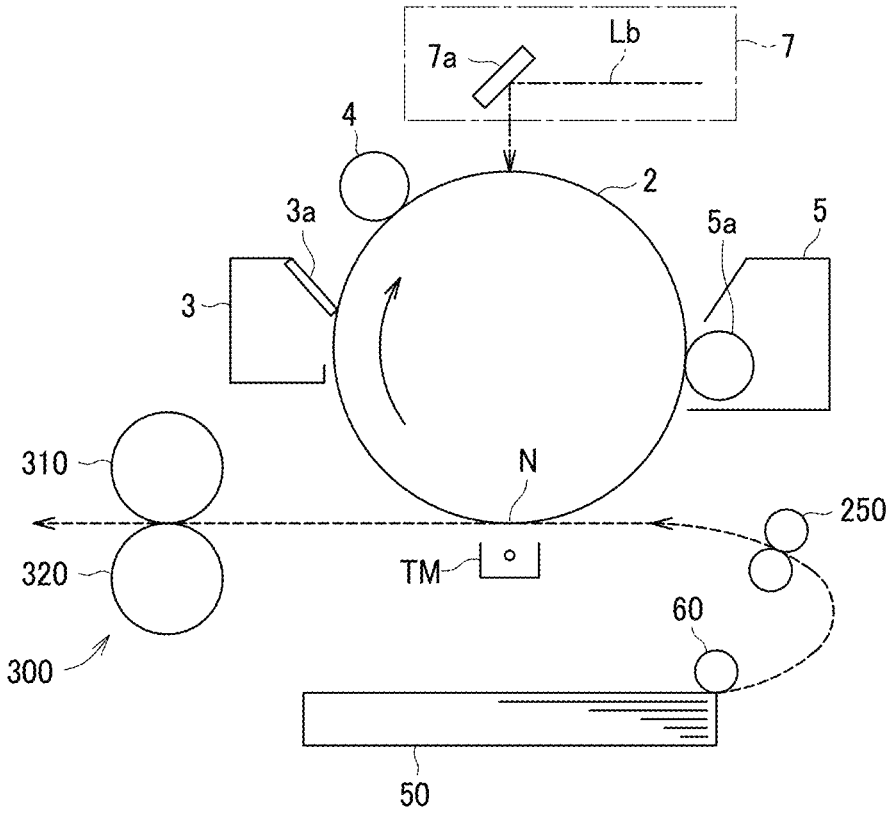
FIG. 1B is a schematic diagram illustrating the principle of how an image forming apparatus operates, according to the embodiment of the present disclosure.

FIG. 1A is a schematic view of a configuration of an image forming apparatus 100 (illustrated as a color laser printer) including a fixing device 300 according to an embodiment of the present disclosure. FIG. 1B is a schematic diagram to simply describe principles of operations in the color laser printer.

The image forming apparatus 100 includes four process units 1K, 1Y, 1M, and 1C as image forming devices. Suffixes, which are K, Y, M, and C, are used to indicate respective colors of toners (black, yellow, magenta, and cyan toners in this example) for the process units. The process units 1K, 1Y, 1M, and 1C have substantially the same configuration except for containing different color toners of black (K), yellow (Y), magenta (M), and cyan (C) corresponding to color separation components of a color image.

The process units 1K, 1Y, 1M, and 1C respectively include toner bottles 6K, 6Y, 6M, and 6C containing different color toners. The process units 1K, 1Y, 1M, and 1C have a similar structure except the color of toner. Thus, the configuration of the one process unit 1K is described below, and the descriptions of the other process units 1Y, 1M, and 1C are omitted.

The process unit 1K includes an image bearer 2K such as a photoconductor drum, a photoconductor cleaner 3K, and a discharger. The process unit 1K further includes a charging device 4K as a charger that uniformly charges the surface of the image bearer and a developing device 5K as a developing unit that renders visible an electrostatic latent image formed on the image bearer. The process unit 1K is detachably attachable to a main body of the image forming apparatus 100. Consumable parts of the process unit 1K can be replaced at one time.

An exposure device 7 is disposed above the process units 1K, 1Y, 1M, and 1C in the image forming apparatus 100. The exposure device 7 performs writing and scanning based on image data, in other words, irradiates the image bearer 2K with laser light L emitted by a laser diode and reflected by mirrors 7*a* based on the image data.

A transfer device 15 is disposed below the process units 1K, 1Y, 1M, and 1C in the present embodiment. The transfer device 15 corresponds to a transfer unit TM in FIG. 1B. Primary transfer rollers 19K, 19Y, 19M, and 19C are disposed in contact with an intermediate transfer belt 16 and to face the image bearers 2K, 2Y, 2M, and 2C, respectively.

The intermediate transfer belt 16 is stretched around and entrained by the primary transfer rollers 19K, 19Y, 19M, and 19C, a drive roller 18, and a driven roller 17 to rotate in a circulating manner. A secondary transfer roller 20 is disposed opposite the drive roller 18 to contact the intermediate transfer belt 16. Note that, when the image bearers 2K, 2Y, 2M, and 2C serve as primary image bearers to bear images of the respective colors, the intermediate transfer belt 16 serves as a secondary image bearer to bear a composite image in which the images on the respective image bearers 2K, 2Y, 2M, and 2C are superimposed one on another.

A belt cleaner 21 is disposed downstream from the secondary transfer roller 20 in a direction of rotation of the intermediate transfer belt 16. A cleaning backup roller is disposed opposite the belt cleaner 21 via the intermediate transfer belt 16.

A sheet feeder 200 including a tray loaded with sheets P is disposed in a lower portion of the image forming apparatus 100. The sheet feeder 200 serves as a recording-medium supply device and can store a bundle of a large number of sheets P as recording media. The sheet feeder 200 is integrated as a single unit together with a sheet feed roller 60 and a roller pair 210 as a conveyor for the sheets P.

The sheet feeder 200 is detachably inserted in the main body of the image forming apparatus 100 to supply the sheet. The sheet feed roller 60 and the roller pair 210 are disposed at an upper portion of the sheet feeder 200 and convey the uppermost one of the sheets P in the sheet feeder 200 to a sheet feeding path 32.

A registration roller pair 250 as a separation conveyor is disposed near the secondary transfer roller 20 and upstream from the secondary transfer roller 20 in a sheet conveyance direction and can temporarily stop the sheet P fed from the sheet feeder 200. Temporarily stopping the sheet P causes slack on the leading-edge side of the sheet P and corrects a skew of the sheet P.

A registration sensor 31 is disposed immediately upstream from the registration roller pair 250 in the sheet conveyance direction and detects passage of a leading edge of the sheet. When a predetermined time passes after the registration sensor 31 detects the passage of the leading edge of the sheet, the sheet contacts the registration roller pair 250 and temporarily stops.

Conveyance rollers 240 are disposed downstream from the sheet feeder 200 to convey the sheet, which has been conveyed to the right side from the roller pair 210, upward. As illustrated in FIG. 1A, the conveyance rollers 240 conveys the sheet to the registration roller pair 250 upward.

The roller pair 210 includes a pair of an upper roller and a lower roller. The roller pair 210 can adopt a friction reverse roller (feed and reverse roller (FRR)) separation system or a friction roller (FR) separation system.

In the FRR separation system, a separation roller (a return roller) is applied with a certain amount of torque in a counter sheet feeding direction from a driving shaft via a torque limiter and pressed against a feed roller to separate sheets in a nip between the separation roller and the feed roller. In the FR separation system, a separation roller (a friction roller) is supported by a secured shaft via a torque limiter and pressed against a feed roller to separate sheets in a nip between the separation roller and the feed roller.

The roller pair 210 in the present embodiment has a configuration of the FRR separation system. That is, the roller pair 210 includes a feed roller 220 and a separation roller 230. The feed roller 220 is an upper roller of the roller pair 210 and conveys a sheet toward an inner side of the image forming apparatus 100. The separation roller 230 is a lower roller of the roller pair 210. A driving force acting in a direction opposite a direction in which a driving force is given to the feed roller 220 is given to the separation roller 230 by a driving shaft through a torque limiter.

The separation roller 230 is pressed against the feed roller 220 by a pressing member such as a spring. A clutch transmits the driving force of the feed roller 220 to the sheet feed roller 60. Thus, the sheet feed roller 60 rotates left in FIG. 1A.

The registration roller pair 250 feeds the sheet P, which has contacted the registration roller pair 250 and has been slackened at the leading-edge side of the sheet P, toward a secondary transfer nip between the secondary transfer roller 20 and the drive roller 18, which is illustrated as a transfer nip N in FIG. 1B, at a suitable timing to transfer a toner image on the intermediate transfer belt 16 onto the sheet P. A bias applied at the secondary transfer nip electrostatically transfers the toner image formed on the intermediate transfer belt 16 onto the fed sheet P at a desired transfer position with high accuracy.

A post-transfer conveyance path 33 is disposed above the secondary transfer nip between the secondary transfer roller 20 and the drive roller 18. The fixing device 300 is disposed near an upper end of the post-transfer conveyance path 33. The fixing device 300 includes a fixing belt 310 as a heating rotator including a heat generator and a pressure roller 320 as a pressure rotator that rotates while contacting the fixing belt 310 with a predetermined pressure.

A post-fixing conveyance path 35 is disposed above the fixing device 300 and branches into a sheet ejection path 36 and a reverse conveyance path 41 at the upper end of the post-fixing conveyance path 35. At this branching portion, the switching member 42 is disposed and pivots on a pivot shaft 42*a*. At an opening end of the sheet ejection path 36, a pair of sheet ejection rollers 37 is disposed.

The reverse conveyance path 41 begins from the branching portion and converges into the sheet feeding path 32. Additionally, a reverse conveyance roller pair 43 is disposed midway in the reverse conveyance path 41. An upper face of the image forming apparatus 100 is recessed to an inner side of the image forming apparatus 100 and serves as an output tray 44.

A powder container 10 such as a toner container is disposed between the transfer device 15 and the sheet feeder 200. The powder container 10 is removably installed in the main body of the image forming apparatus 100.

The image forming apparatus 100 according to the present embodiment has a predetermined distance from the sheet feed roller 60 to the secondary transfer roller 20 in consideration of the conveyance of a sheet on which a toner image is to be transferred. The powder container 10 is disposed in a dead space caused by the predetermined distance to keep the entire image forming apparatus compact.

A transfer cover 8 is disposed above the sheet feeder 200 and on a front side to which the sheet feeder 200 is pulled out. The transfer cover 8 can be opened to check an interior of the image forming apparatus 100. The transfer cover 8 includes a bypass feed roller 45 for bypass sheet feeding and a bypass feed tray 46 for the bypass sheet feeding.

Next, the principle of the above-described image forming apparatus 100 is described with reference to FIG. 1B.

The image forming apparatus 100 includes an image bearer 2 such as a photoconductor drum and a photoconductor cleaner 3. The image forming apparatus 100 further includes a charging device 4 as a charger that uniformly charges the surface of the image bearer, a developing device 5 that renders visible an electrostatic latent image on the image bearer, a transfer device TM disposed under the image bearer 2, the discharger, and the like.

An exposure device 7 is disposed above the image bearer 2. The exposure device 7 performs writing and scanning based on image data, that is to say, irradiates the image bearer 2 with laser light Lb emitted by a laser diode based on image data and reflected by a mirror 7*a*.

The sheet feeder 200 including a tray that loads sheets P is disposed below the image forming apparatus 100. The sheet feeder 200 serves as a recording-medium supply device and can store a bundle of a large number of sheets P as recording media. The sheet feeder 200 is integrated as a single unit together with the sheet feed roller 60 as the conveyor for the sheets P.

Downstream from the sheet feed roller 60, a registration roller pair 250 as a separation and conveyance means is disposed. The registration roller pair 250 temporarily stops the sheet P fed from the sheet feeder 200. Temporarily stopping the sheet P causes slack on the leading-edge side of the sheet P and corrects a skew of the sheet P.

The registration roller pair 250 sends the sheet P contacting the registration roller pair 250 and having the slack on the leading-edge side toward a transfer nip N of the transfer device TM at a timing to suitably transfer a toner image on the image bearer 2 onto the sheet P. A bias applied at the transfer nip N electrostatically transfers the toner image formed on the image bearer 2 onto the sent sheet P at a desired transfer position.

The fixing device 300 is disposed downstream from the transfer nip N. The fixing device 300 includes the fixing belt 310 heated by a heater, and a pressure roller 320 that rotates while contacting the fixing belt 310 with a predetermined pressure. Note that a fixing roller may be used instead of the fixing belt 310.

Referring to FIG. 1A, operations of the image forming apparatus 100 according to the present embodiment are described below. First, operations of a simplex or single-sided printing are described.

Referring to FIG. 1A, the sheet feed roller 60 rotates in response to a sheet feeding signal from a controller of the image forming apparatus 100. The sheet feed roller 60 separates the uppermost sheet from a bundle of sheets P (also referred to as sheet bundle) loaded in the sheet feeder 200 and feeds the uppermost sheet to the sheet feeding path 32.

When the leading edge of the sheet P, which has been fed by the sheet feed roller 60 and the roller pair 210, reaches a nip of the registration roller pair 250, the sheet P is slackened and temporarily stopped by the registration roller pair 250. The registration roller pair 250 corrects the skew on the leading-edge side of the sheet P and rotates in synchronization with an optimum timing so that a toner image formed on the intermediate transfer belt 16 is transferred onto the sheet P.

When the sheet P is fed from the bypass feed tray 46, sheets P of the sheet bundle loaded on the bypass feed tray 46 are fed one by one from the uppermost sheet of the sheet bundle by the bypass feed roller 45. Then, the sheet P passes a part of the reverse conveyance path 41 and is conveyed to the nip of the registration roller pair 250. The subsequent operations are the same as the sheet feeding operations from the sheet feeder 200.

As to image formation, operations of the process unit 1K are described as representative, and descriptions of the other process units 1Y, 1M, and 1C are omitted here. First, the charging device 4K uniformly charges the surface of the image bearer 2K to high potential. The exposure device 7 irradiates the surface of the image bearer 2K with laser light L according to image data.

The surface of the image bearer 2K irradiated with the laser light L has an electrostatic latent image due to a drop in the potential of the irradiated portion. The developing device 5K includes a developer bearer to bear developer including toner and transfers unused black toner supplied from the toner bottle 6K onto the irradiated portion of the surface of the image bearer 2K having the electrostatic latent image through the developer bearer.

The image bearer 2K to which the toner has been transferred forms (develops) a black toner image on the surface of the image bearer 2K. The black toner image formed on the image bearer 2K is transferred onto the intermediate transfer belt 16.

The photoconductor cleaner 3K removes residual toner remaining on the surface of the image bearer 2K after an intermediate transfer operation. The removed residual toner is conveyed by a waste toner conveyor and collected to a waste toner container in the process unit 1K. The discharger discharges the remaining charge on the image bearer 2K from which the remaining toner is removed by the photoconductor cleaner 3K.

Similarly, toner images are formed on the image bearers 2Y, 2M, and 2C in the process units 1Y, 1M, and 1C for the colors, and color toner images are transferred to the intermediate transfer belt 16 such that the color toner images are superimposed on one on another.

The intermediate transfer belt 16 on which the color toner images are transferred and superimposed travels such that the color toner images reach the secondary transfer nip between the secondary transfer roller 20 and the drive roller 18. The registration roller pair 250 rotates to nip the sheet P contacting the registration roller pair 250 at a predetermined timing and conveys the sheet P to the secondary transfer nip of the secondary transfer roller at a suitable timing such that a composite toner image formed by superimposing and transferring the toner images on the intermediate transfer belt 16 is transferred onto the sheet P. In this manner, the composite toner image on the intermediate transfer belt 16 is transferred to the sheet P sent out by the registration roller pair 250.

The sheet P having the transferred composite toner image is conveyed to the fixing device 300 through the post-transfer conveyance path 33. The sheet P conveyed to the fixing device 300 is nipped by the fixing belt 310 and the pressure roller 320. The unfixed toner image is fixed onto the sheet P under heat and pressure in the fixing device 300. The sheet P, on which the composite toner image has been fixed, is sent out from the fixing device 300 to the post-fixing conveyance path 35.

When the fixing device 300 sends out the sheet P, the switching member 42 is at a position at which the upper end of the post-fixing conveyance path 35 is open, as indicated by the solid line of FIG. 1A. The sheet P sent out from the fixing device 300 is sent to the sheet ejection path 36 via the post-fixing conveyance path 35. The pair of sheet ejection rollers 37 nips the sheet P sent out to the sheet ejection path 36 and rotates to eject the sheet P to the output tray 44. Then, the single-sided printing is finished.

Next, a description is given of operations of a duplex or double-sided printing. Similar to the single-sided printing described above, the fixing device 300 sends out the sheet P to the sheet ejection path 36. In the duplex printing, the pair of sheet ejection rollers 37 rotates to convey a part of the sheet P outside the image forming apparatus 100.

When the trailing edge of the sheet P passes through the sheet ejection path 36, the switching member 42 pivots on the pivot shaft 42*a* as indicated with a dotted line in FIG. 1A to close the upper end of the post-fixing conveyance path 35. When the upper end of the post-fixing conveyance path 35 is closed, substantially simultaneously, each of the pair of sheet ejection rollers 37 rotates in reverse (in other words, in a direction opposite to the direction to convey a part of the sheet P outside the image forming apparatus 100) to convey the sheet P to an inner side of the image forming apparatus 100, that is, to the reverse conveyance path 41.

The sheet P sent out to the reverse conveyance path 41 reaches the registration roller pair 250 through the reverse conveyance roller pair 43. The registration roller pair 250 sends out the sheet P to the secondary transfer nip at a suitable timing such that the toner image formed on the intermediate transfer belt 16 is transferred onto the other surface of the sheet P to which no toner image has been transferred.

When the sheet P passes through the secondary transfer nip, the secondary transfer roller 20 and the drive roller 18 transfer the toner image to the other surface (back side) of the sheet P to which no toner image has been transferred. The sheet P having the transferred toner image is conveyed to the fixing device 300 through the post-transfer conveyance path 33.

In the fixing device 300, the sheet P is nipped by the fixing belt 310 and the pressure roller 320, and the unfixed toner image are fixed on the back side of the sheet P under heat and pressure. The sheet P having the toner images fixed to both front and back sides of the sheet P in this manner is sent out from the fixing device 300 to the post-fixing conveyance path 35.

When the fixing device 300 sends out the sheet P, the switching member 42 is at a position at which the upper end of the post-fixing conveyance path 35 is open, as indicated by the solid line of FIG. 1A. The sheet P sent out from the fixing device 300 is sent to the sheet ejection path 36 via the post-fixing conveyance path 35. The pair of sheet ejection rollers 37 nips the sheet P sent out to the sheet ejection path 36 and rotates to eject the sheet P to the output tray 44. Thus, the duplex printing is finished.

After the toner image on the intermediate transfer belt 16 is transferred onto the sheet P, residual toner remains on the intermediate transfer belt 16. The belt cleaner 21 removes the residual toner from the intermediate transfer belt 16. The waste toner conveyor conveys the toner removed from the intermediate transfer belt 16 to the powder container 10, and the toner is collected inside the powder container 10.

Figure 2:
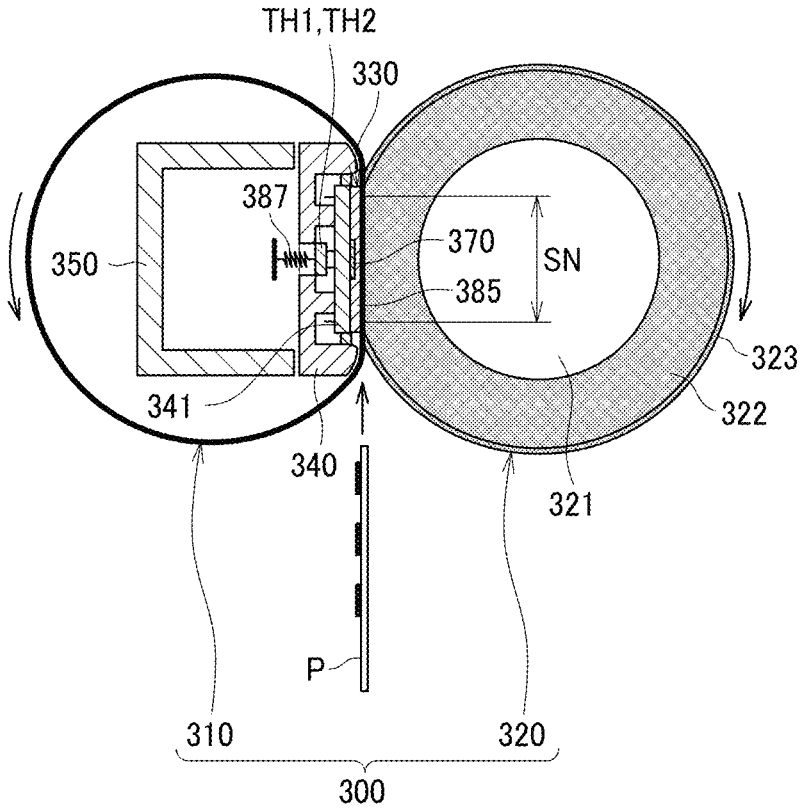
FIG. 2 is a cross-sectional view illustrating a fixing device used in the image forming apparatus in FIG. 1.

Next, a description is given of the fixing device 300 according to the present embodiment of the present disclosure. As illustrated in FIG. 2, the fixing device 300 includes a thin fixing belt 310 having low thermal capacity and a pressure roller 320. The fixing belt 310 includes, for example, a tubular base made of polyimide (PI). The tubular base has an outer diameter of 25 mm and a thickness of from 40 micrometers (μm) to 120 μm.

The fixing device 300 may be a roller fixing system or a belt fixing system in addition to the system using the fixing belt 310 as illustrated in FIG. 2. In any one of the fixing systems, heating small sheets P to fix the toner images onto the small sheets P may cause an excessive temperature rise in a non-sheet passage portion of the heating rotator through which the sheets P do not pass because the sheets P absorb heat of the heater from a sheet passage portion of the heating rotator through which the sheets P pass but do not absorb the heat from the non-sheet passage portion.

The fixing belt 310 includes a release layer serving as an outermost surface layer. The release layer is made of fluororesin, such as tetrafluoroethylene-perfluoroalkylvinylether copolymer (PFA) and polytetrafluoroethylene (PTFE), and has a thickness of from 5 μm to 50 μm to enhance durability of the fixing belt 310 and facilitate separation of the sheet P from the fixing belt 310. An elastic layer made of rubber having a thickness of from 50 to 500 μm may be interposed between the base and the release layer.

The base of the fixing belt 310 may be made of heat resistant resin such as polyetheretherketone (PEEK) or metal such as nickel (Ni) and SUS stainless steel, instead of polyimide. An inner circumferential surface of the fixing belt 310 may be coated with polyimide, PTFE, or the like to produce a slide layer.

A detailed description is now given of a construction of the pressure roller 320. The pressure roller 320 has an outer diameter of 25 mm, for example. The pressure roller 320 includes a cored bar 321, an elastic layer 322, and a release layer 323. The cored bar 321 is solid and made of metal such as iron. The elastic layer 322 coats the cored bar 321. The release layer 323 coats an outer surface of the elastic layer 322. The elastic layer 322 is made of silicone rubber and has, for example, a thickness of 3.5 mm.

Preferably, the release layer 323 is formed by a fluororesin layer having, for example, a thickness of approximately 40 μm on the surface of the elastic layer 322 to enhance releasability. A biasing member presses the pressure roller 320 against the fixing belt 310.

A stay 350 and a heater holder 340 are disposed inside the fixing belt 310 and extend in the axial direction of the fixing belt 310. The stay 350 is made of a metal channel member, and both side plates of the fixing device 300 support both end portions of the stay 350. The stay 350 reliably receives the pressing force of the pressure roller 320 to stably form a fixing nip SN.

The heater holder 340 holds a base 341 of the heater 330 of the fixing device 300 and is supported by the stay 350. Preferably, the heater holder 340 is made of heat-resistant resin having low thermal conduction, such as a liquid crystal polymer (LCP). Such a configuration can reduce heat transfer to the heater holder 340 and effectively heat the fixing belt 310.

The heater holder 340 has a shape that supports two portions of the base 341 near both end portions in a shorter-side direction of the base 341 to avoid contact with a high-temperature portion of the base 341. Thus, the amount of heat flowing to the heater holder 340 can be further reduced to effectively heat the fixing belt 310.

The fixing device 300 includes thermistors TH1 and TH2 as temperature detectors disposed on the back side of the base 341 to detect temperatures of a resistance member 370 of the heater 330. The resistance member is described below. The thermistors TH1 and TH2 are pressed against the back side of the base 341 by a spring 387, due to the configuration, the accurate temperature of the resistance member 370 can be detected.

One of the thermistors TH1 is disposed at a position corresponding to the center of the sheet passage portion of a small sheet in a width direction of a sheet. The other of the thermistors TH2 is disposed at a position corresponding to the non-sheet passage portion of a large sheet that is outside of the sheet passage portion of the large sheet in the width direction. Based on temperature data from both thermistors TH1 and TH2, the controller controls the electric power supplied to the resistance member 370 and a driver of a shutter 305 described later. As a result, the controller can effectively prevent the temperature rise in the non-sheet passage portion.

A thermistor disposed opposite the outer peripheral surface of the pressure roller 320 may be substituted for the thermistor TH1 or TH2. Since disposing the thermistor facing the pressure roller 320 means disposing the thermistor outside the fixing belt 310, maintenance of the thermistor is easy. The fixing device 300 may be various types of fixing devices, and the fixing device 300 in FIG. 2A described above is just one example.

With reference to FIGS. 3A to 3F, the following describes the fixing device 300 including a shutter 305 according to the embodiment of the present disclosure.

Figure 3A:
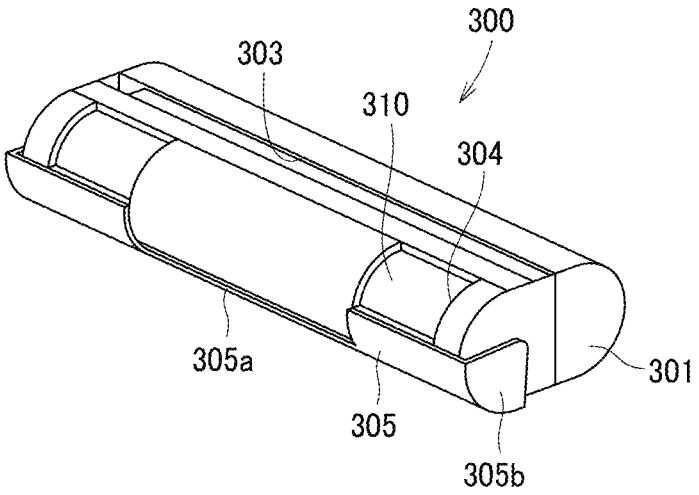
FIG. 3A is a perspective view of the fixing device with a shutter opened according to the embodiment of the present disclosure.
Figure 3B:
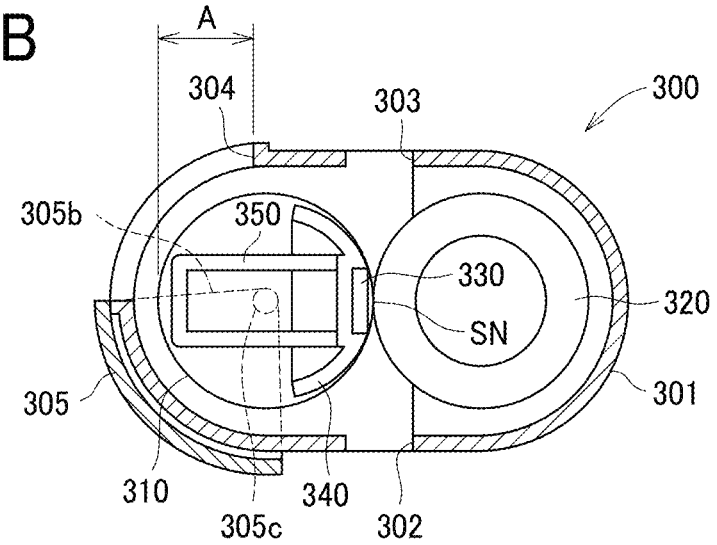
FIG. 3B is a cross-sectional view of the fixing device with the shutter opened according to the embodiment of the present disclosure.

As illustrated in FIG. 3B, the fixing device 300 includes a housing (cover) 301 to house the fixing belt 310 as the heating rotator and the pressure roller 320 as the pressure rotator, which are described above, to thermally insulate the fixing belt 310 and the pressure roller 320 and keep the temperatures of the fixing belt 310 and the pressure roller 320.

The housing 301 has a compact cross-sectional shape in which two arcs face each other in the horizontal direction so as not to form a useless space outside the fixing belt 310 and the pressure roller 320 housed inside. The housing 301 has an inlet 302 in a lower planar portion and an outlet 303 in an upper planar portion.

The inlet 302 and the outlet 303 face each other in a direction (that is a vertical direction in FIG. 3B) crossing the longitudinal direction of the fixing belt 310 (that is an axial direction of the fixing belt 310 perpendicular to the surface of the paper in FIG. 3B). The sheet bearing the toner image enters at the inlet 302, passes through the fixing nip SN, and exits from the outlet 303.

As illustrated in FIG. 3A, the housing 301 has a pair of rectangular openings 304 formed from the half of the arc-shaped side of the housing 301 in a height direction to the upper end of the housing 301. The pair of openings 304 are disposed at both end portions in the longitudinal direction of the housing 301 and opens toward both end portions of the fixing belt 310 in the longitudinal direction of the fixing belt 310 that are non-sheet passage portions.

Each of the openings 304 is connected to an air duct 510 as described below with reference to FIGS. 3I and 3J. Here, existence of airflow between the opening 304 and the air duct 510 means that the opening 304 is connected to the air duct 510 even if there is a gap between the opening 304 and the air duct 510.

A blower fan 520 is disposed in the air duct 510 outside the opening 304. The blower fan 520 supplies cooling air to the opening 304. The combination of the air duct 510 and the blower fan 520 effectively prevents the temperature rise in the non-sheet passage portion.

Next, the shutter 305 is described.

As illustrated in FIG. 3A, the fixing device 300 includes a pair of shutters 305 disposed at a right portion and a left portion of the fixing device 300 so as to cover the openings 304. Adjusting an opening level of the shutter 305 enables adjusting the amount of cooling air supplied to the opening 304. The pair of left and right shutters 305 are connected to each other by a joint 305*a* extending in the longitudinal direction of the housing 301. The joint 305*a* enables producing the shutters 305 as a single member and reduces the cost of a shutter mechanism.

Figure 3C:
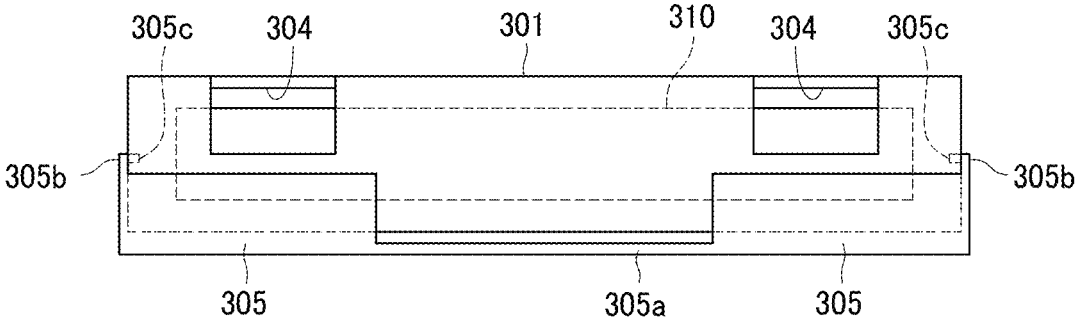
FIG. 3C is a front view of the fixing device with the shutter opened according to the embodiment of the present disclosure.
Figure 3D:
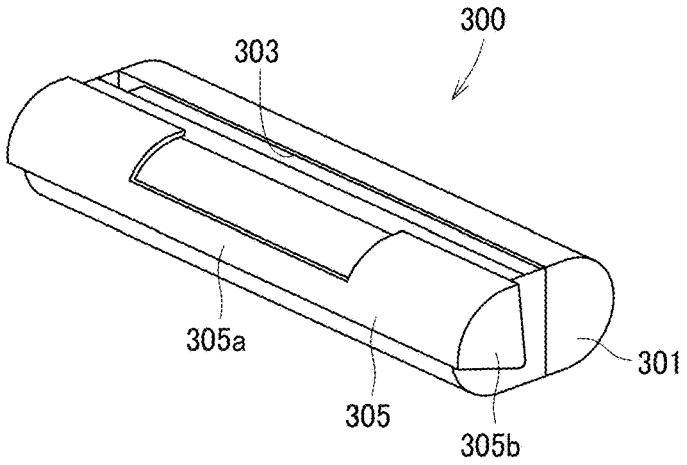
FIG. 3D is a perspective view of the fixing device with the shutter closed according to the embodiment of the present disclosure.

As illustrated in FIG. 3B, the shutters 305 each have an arc-shaped cross section. In addition, as illustrated in FIGS. 3A to 3C, each of the shutters 305 includes a fan-shaped arm 305*b* connected to the outer end of the shutter 305 in the longitudinal direction. The arm 305*b* includes a shaft-portion 305*c* formed at the tip end of the arm 305*b* and rotatably supported on the side of the housing 301.

Viewing the side of the fixing device 300, that is, in FIG. 3B, the shaft-portion 305*c* is disposed inside of the fixing belt 310 (substantially at the center of the loop of the fixing belt 310). In other words, the shaft-portion 305*c* is on an axis extending in the longitudinal direction of the fixing belt 310, and the axis is inside a cross section of the fixing belt 310 orthogonal to the longitudinal direction of the fixing belt 310. The axis may be an imaginary line or a shaft that is a structural member that supports the fixing belt. The above-described configuration can minimize the trajectory of rotation of the shutter 305 about the shaft-portion 305*c* when the shutter 305 opens and closes and reduce the size of the entire image forming apparatus.

Figure 3E:
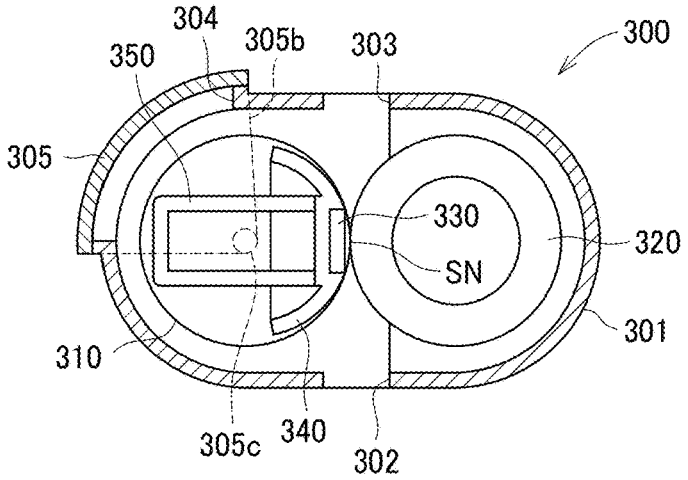
FIG. 3E is a cross-sectional view of the fixing device with the shutter closed according to the embodiment of the present disclosure.
Figure 3F:
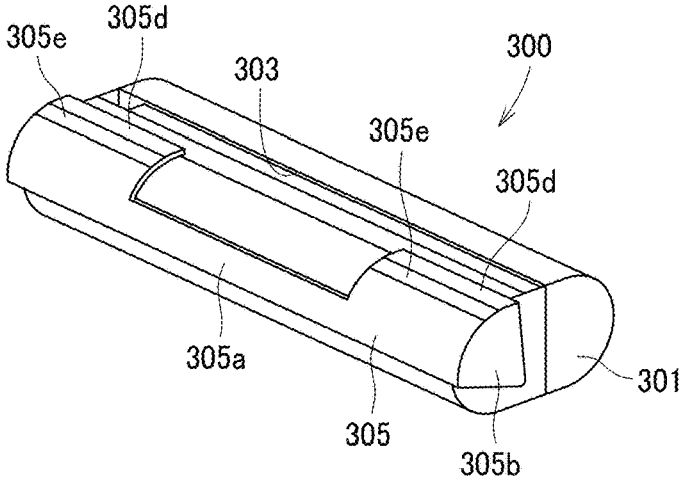
FIG. 3F is a perspective view of the fixing device with the shutter closed according to a modification of the embodiment of the present disclosure.

The shutter 305 has a curved shape covering the fixing belt 310. In other words, the shutter 305 has the curved shape outside the outer circumference of the fixing belt 310. In the present embodiment, the shape of the entire shutter 305 is the curved shape with the shaft-portion 305*c* as the center of curvature. However, as illustrated in FIG. 3F, the shutter 305 may partially include flat portions 305*d* and 305*e* each having a straight line in the cross-sectional view of the fixing device 300. Alternatively, the shutter 305 may partially include a curved shape. The curvature of the shutter 305 may be measured using, for example, a laser microscope (VK-X100) manufactured by Keyence Corporation.

In short, there is no problem as long as the shutter 305 has the shape substantially covering the fixing belt 310 and a compact configuration that rotates about the shaft-portion 305*c* to open and close the shutter 305. The above-described curved shape can minimize the trajectory of rotation of the shutter 305 about the shaft-portion 305*c* when the shutter 305 opens and closes and reduce the size of the entire image forming apparatus.

The shaft-portion 305*c* is coaxially coupled to a rotation shaft of a motor having a decelerator on an outer side face of the arm 305*b*. The shutter 305 is opened and closed by the normal rotation and reverse rotation of the motor. Since the motor can be disposed near the end in the longitudinal direction of the fixing device 300, the above-described driving system is simpler and smaller (that enables saving space) than a driving system with a rack-and-pinion mechanism disposed in the central portion in the longitudinal direction of the housing.

Figure 4A:
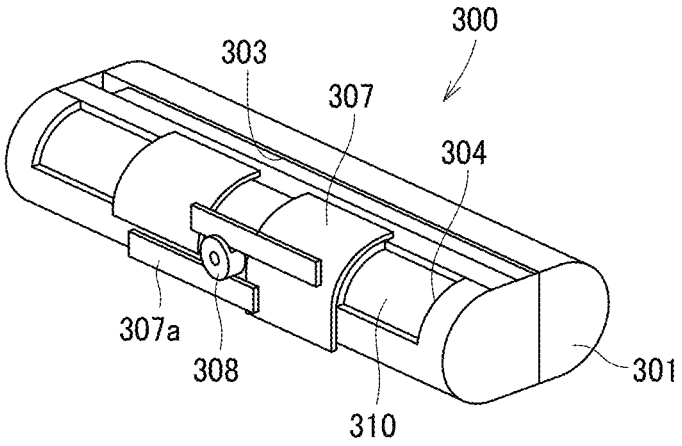
FIG. 4A is a perspective view of the fixing device with the shutter opened according to a comparative embodiment.
Figure 4B:
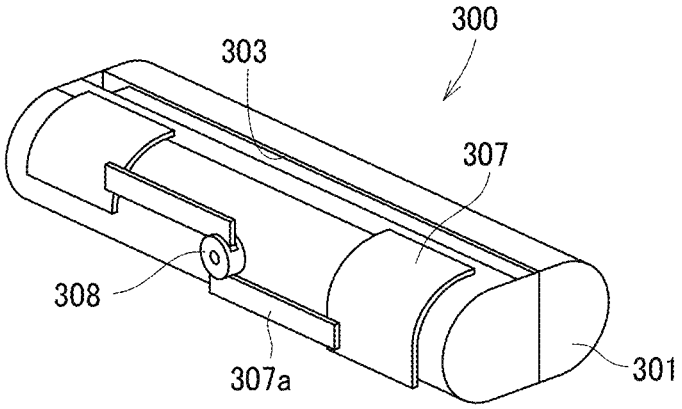
FIG. 4B is a perspective view of the fixing device with the shutter closed according to the comparative embodiment.

FIGS. 4A and 4B are perspective views of the fixing device including the driving system with the rack-and-pinion mechanism. In FIG. 4A, shutters 307 are opened, and in FIG. 4B, the shutters 307 are closed. Since a pinion 308 disposed at a center in the longitudinal direction of the housing needs a drive transmission system configured from the end in the longitudinal direction of the fixing device 300 to the center to drive the pinion 308, it is difficult to simplify a drive transmission system and save space.

The pair of left and right shutters 307 are disposed so as to be slidable in the longitudinal direction of the housing of the fixing device 300, and a pinion 308 disposed at the center of the fixing device 300 in the longitudinal direction meshes with racks 307*a* extending from the shutters 307 toward the center in the longitudinal direction. Rotations of the pinion 308 cause the left and right shutters 307 to approach and separate from each other, thereby opening and closing the openings 304.

Figure 4C:
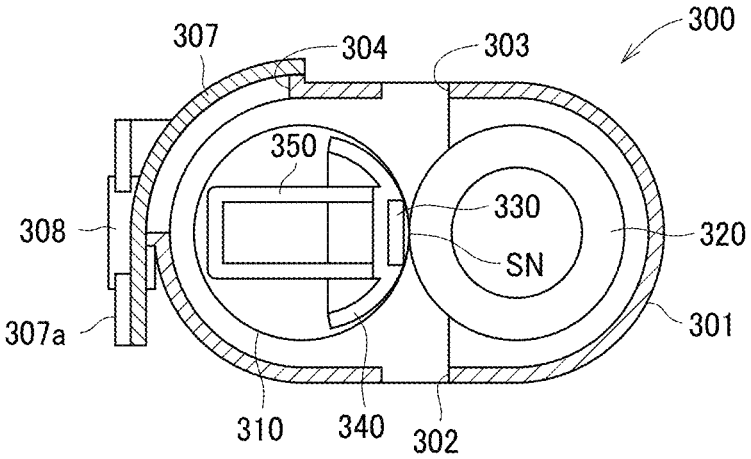
FIG. 4C is a cross-sectional view of the fixing device with the shutter closed according to the comparative embodiment.

FIG. 4C is a cross-sectional view of the fixing device 300 with the shutter 307 closed. Since the shutters 307 move and slide in the longitudinal direction to open and close the openings, the heated air rises from a limited region in the longitudinal direction of the openings 304 when the shutters 307 open half of the openings 304. As a result, the above-described configuration limits a range in which condensation on the branching portion is prevented. Preventing the condensation on the branching portion is described below.

Figure 3G:
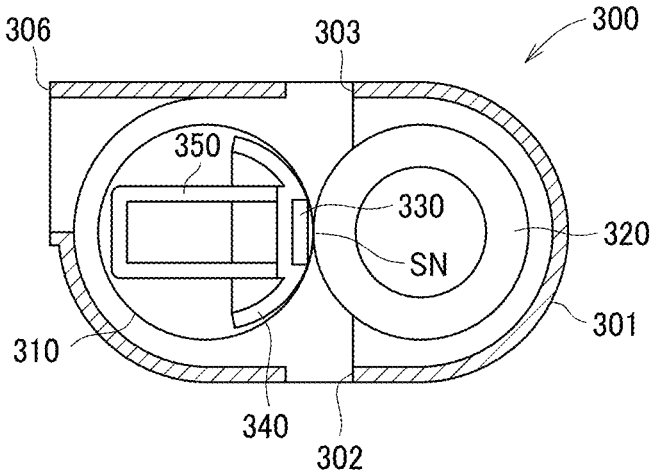
FIG. 3G is a schematic cross-sectional view of a fixing device according to a comparative embodiment having a lateral opening that is difficult to release heat.
Figure 3H:
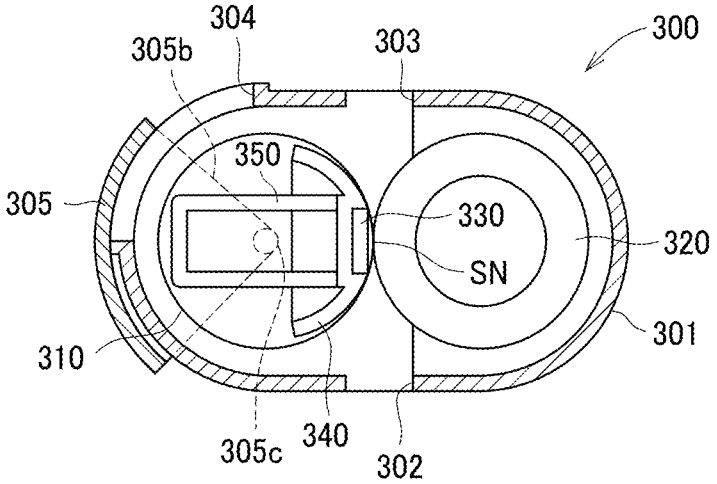
FIG. 3H is a cross-sectional view of the fixing device with the half-open shutter according to the embodiment of the present disclosure.

In contrast, in the present embodiment, the heated air rises from the entire width of the openings 304 in the longitudinal direction even when the shutters 305 open the half of the openings 304 as illustrated in FIG. 3H. As a result, the configuration in the present embodiment can maximize the range in which condensation of the branching portion is prevented.

The shutter 305 may be a press-molded product of heat-resistant sheet metal. The shutter 305 that is the press-molded product can improve the dimension accuracy of the shutter.

A heat insulator (heat insulating member) such as felt or sponge may be attached to the inner surface of the shutter 305 to improve the heat insulating property. Further, even when the shutter 305 is made of heat-resistant resin, the heat insulator (heat insulating member) may be attached to the back face thereof.

Specifically, as illustrated in FIG. 3B, the opening 304 is in an upper portion of the housing 301 in a height direction, that is, in a region from the center in the height direction of the arc-shaped side face of the housing 301 to the ceiling of the housing 301 in the height direction when the fixing device 300 heats the sheet. In addition, in the longitudinal direction of the housing 301, the openings 304 face both end portions of the fixing belt 310 as illustrated in FIG. 3C.

In other words, the opening 304 is opened obliquely upward when the fixing device 300 heats the sheet as illustrated in FIG. 3B. The opening 304 is almost entirely visible when viewed from directly above the housing 301 but is not visible when viewed from directly below the housing 301. Opening upward or obliquely upward can efficiently discharge excessive heat, which causes excessive temperature rise at the end portions of the fixing belt 310, from the openings 304 to the outside of the housing 301.

In other words, the opening 304 is disposed at a position at which the opening 304 can be seen even slightly from directly above the fixing device 300 and preferably disposed at a position at which the fixing belt 310 can be seen even slightly through the opening 304 from directly above the fixing device 300. Specifically, a dimension A in FIG. 3B is greater than or equal to zero (0). As illustrated in FIG. 3G, a lateral opening 306 through which the fixing belt 310 cannot be seen at all from directly above the housing 301 cannot efficiently discharge the excess heat that causes the excessive temperature rise of the end portion of the fixing belt 310 to the outside of the housing 301.

As illustrated in FIG. 3H, rotating the shutter 305 upward preferably closes the opening 304 so that heat can be efficiently discharged from the opening 304 to the outside of the housing 301 even when the shutter 305 opens a half of the opening 304. As illustrated in FIG. 3E, the shutter 305 formed by an arc with a central angle of 90 degrees centered on the shaft-portion 305*c* can close the opening 304 formed by an arc with a central angle of 90 degrees centered on the shaft-portion 305*c*.

Just opening the shutter 305 so that a half of the opening 304 or all of the opening 304 is opened can discharge excessive heat, which causes the excessive temperature rise at the end portion of the fixing belt 310, upward. As illustrated in FIG. 3I, an air duct 510 may be horizontally connected to the opening 304, and a blower fan 520 may be disposed in the air duct 510 to enhance the cooling effect for the end portion of the fixing belt 310.

An upper end outlet of the air duct 510 is preferably extended upward from the opening 304 by a predetermined length in order to generate a chimney effect. The "chimney effect" is caused as follows. Air inside a chimney has a higher temperature than air outside the chimney. Therefore, the air inside the chimney has a smaller density than the air outside the chimney. The smaller density generates a floating force. Since the floating force moves the air inside the chimney upward, cool air outside the chimney is drawn from an air intake port at a lower portion of the chimney. Thus, the chimney causes the chimney effect, that is, the above-described air flow. The air duct 510 and the blower fan 520 are disposed in the vicinity of the opening 304 by appropriately and effectively utilizing space in the main body of the image forming apparatus.

The blower fan 520 forcibly blows cooling air into the housing 301 toward the end portions of the fixing belt 310, and the cooling air effectively cools the end portion of the fixing belt 310 and can prevent the excessive temperature rise in the end portions. The air blown into the housing 301 is warmed by the end portion of the fixing belt 310 and naturally discharged upward.

At this time, the chimney effect in the air duct 510 enhances discharging the air. Part of the air blown into the housing 301 is also discharged upward from the outlet 303. The part of the air can prevent condensation on the sheet P conveyed upward from the outlet 303.

The warm air discharged upward as described above can be effectively used to prevent condensation on the branching portion. As illustrated in FIG. 1A, disposing the switching member 42 that guides the sheet to the reverse conveyance path 41 during the duplex printing above the fixing device 300 can prevent condensation on the switching member 42. In order to effectively prevent the condensation, the switching member 42 is preferably disposed vertically above the opening 304.

In order to prevent condensation on the sheet conveyance path, the following measure may be considered. For example, the image forming apparatus may be idled (warmed up) until the condensation is eliminated, or an independent fan may be disposed for eliminating the condensation. The former has a problem in that a waiting time until printing becomes long, and the latter has a problem in that a mechanism is complicated by a fan to increase the size and cost of the apparatus.

Alternatively, disposing an exhaust air shield that can open and close a sheet outlet following the output tray at the sheet outlet and closing the exhaust air shield during timings other than a sheet ejection timing may enhance a heat insulating effect, thereby preventing the condensation. However, such a configuration causes the same problem as the independent fan described above, that is, the complicated mechanism and increasing the size and cost of the apparatus. As in the present embodiment, effectively utilizing the exhaust heat from the end portion of the fixing belt 310 and actively sending the exhaust heat to the condensation portion solve the above-described problems.

Figure 3I:
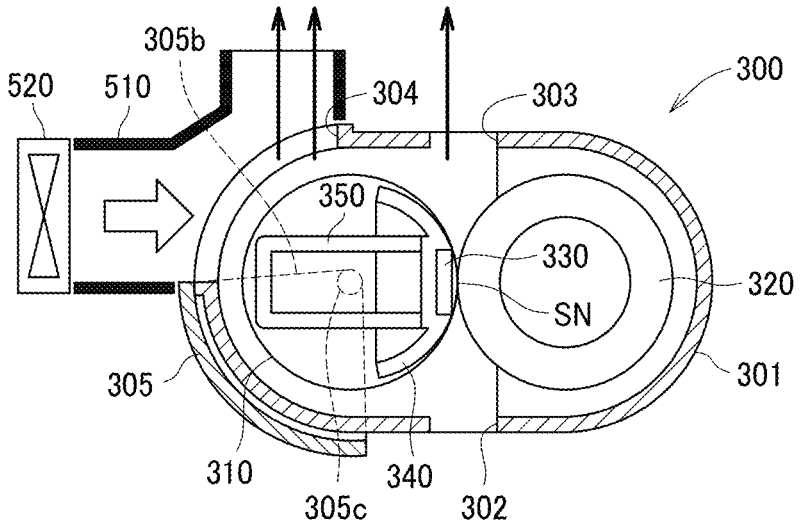
FIG. 3I is a cross-sectional view of the fixing device including a blower fan disposed in an inlet of an air duct, according to a modification of the embodiment of the present disclosure.
Figure 3J:
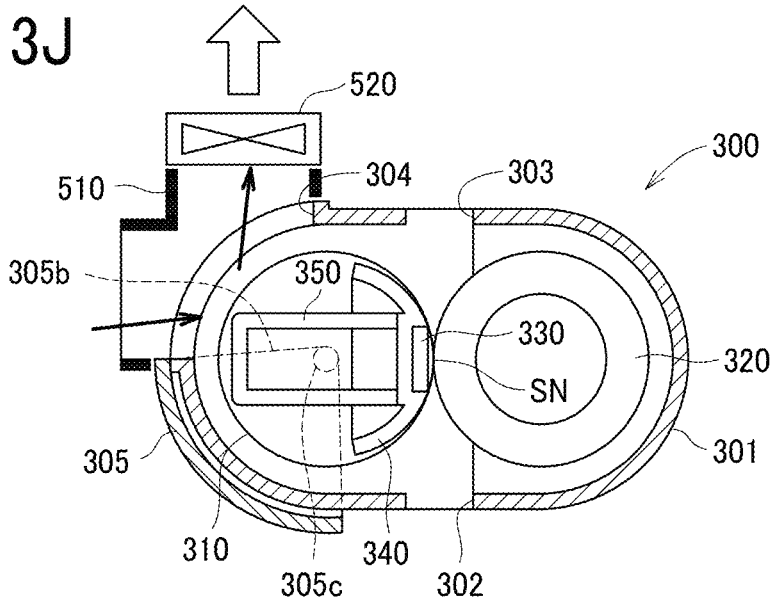
FIG. 3J is a cross-sectional view of the fixing device including the blower fan disposed in an outlet of the air duct, according to a modification of the embodiment of the present disclosure.

The blower fan 520 may be disposed on the inlet of the air duct 510 as illustrated in FIG. 3I or the upper end outlet as illustrated in FIG. 3J. Disposing the blower fan (suction fan) 520 as illustrated in FIG. 3J can enhance the heating action and the ventilation action with respect to the switching member 42 and more reliably achieve the above-described condensation prevention effect.

Next, the heater 330 is described.

As illustrated in FIG. 2, the fixing device 300 includes the heater 330 held by the heater holder 340. The heater 330 includes the resistance member 370 including resistive heat generators such as planer heaters on the base 341. The resistance member 370 can be formed in a plurality of types, such as the resistance member 370 in the heater 330 illustrated as examples in FIGS. 5A and 5B.

In either type, the resistance members 370 are formed on the base 341. The base 341 is an elongated thin metal plate member coated with an insulating material. In the fixing method in which the fixing nip SN is heated by the planar heater, the resistance member serving as the heat generator is divided into a plurality of parts in the width direction of the sheet and individually controlled to be heated, so that a plurality of types of sheet widths can be uniformly heated.

Low-cost aluminum or stainless steel is preferable as the material of the base 341. However, the material of the base 341 is not limited to metal and alternatively may be a ceramic, such as alumina or aluminum nitride, or a nonmetallic material having excellent thermal resistance and insulating properties, such as glass or mica.

To enhance thermal uniformity of the heater 330 and image quality, the base 341 may be made of a material having high thermal conductivity, such as copper, graphite, or graphene. The heater 330 according to the present embodiment uses an alumina base having a lateral width of 8 mm, a longitudinal width of 270 mm, and a thickness of 1.0 mm.

Figure 5A:
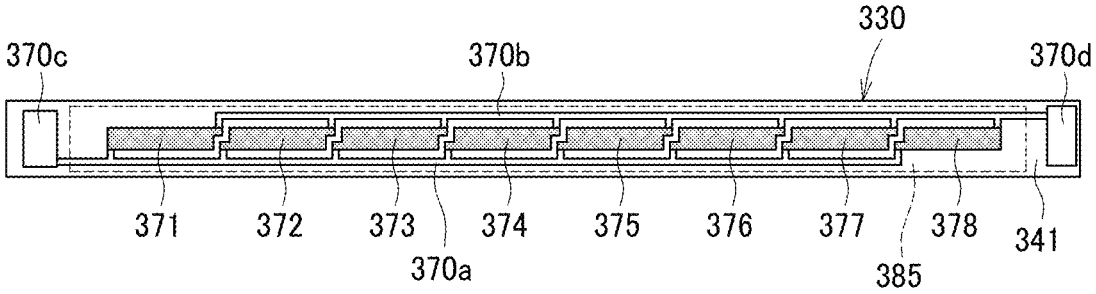
FIGS. 5A and 5B are plan views of heaters including heat generators coupled in parallel to two electrodes at both end portions.
Figure 5B:
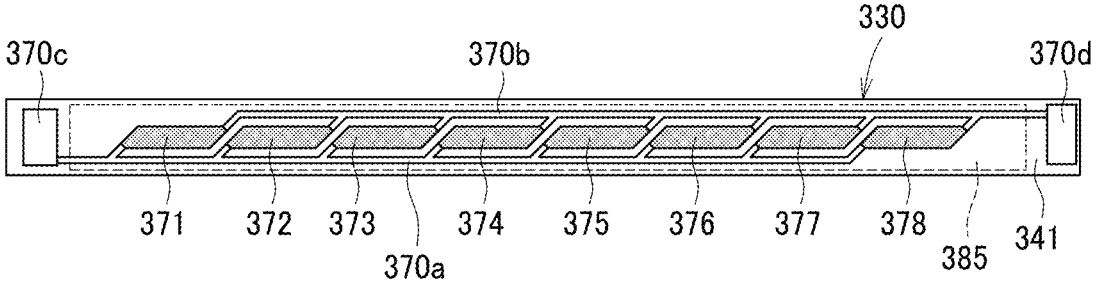

As illustrated in FIGS. 5A and 5B, the heater 330 can be configured as a multi-type in which resistive heat generators 371 to 378 are electrically connected in parallel. The heater 330 includes two electrodes 370*c* and 370*d*. When the resistance value between electrodes 370*c* and 370*d* at both ends is assumed to be 10Ω, the resistance value of each of the resistive heat generators 371 to 378 is increased to 80Ω due to the parallel connection.

PTC elements may be used as the resistive heat generators 371 to 378. The PTC element is made of a material having a positive temperature resistance coefficient and has a characteristic that the resistance value increases as the temperature T increases (the current I decreases, and the heater output decreases). The temperature coefficient of resistance (TCR) may be, for example, 1500 parts per million (PPM).

The resistive heat generators 371 to 378 illustrated in FIGS. 5A and 5B are arranged linearly at equal intervals in the longitudinal direction of the base 341. On both sides of each of the resistive heat generators 371 to 378 in the short-side direction, conductors 370*a* and 370*b* having small resistance values are linearly arranged in parallel to each other. Both ends of each of the resistive heat generators 371 to 378 are connected to the conductors 370*a* and 370*b*. Alternating current (AC) power is supplied to electrodes 370*c* and 370*d* formed at both end portions of each of the conductors 370*a* and 370*b*.

The resistive heat generators 371 to 378 and the conductors 370*a* and 370*b* are covered with a thin insulation layer 385. The insulation layer 385 may be, for example, a thermal resistance glass having a thickness of 75 μm. The insulation layer 385 insulates and protects the resistive heat generators 371 to 378 and the conductors 370*a* and 370*b* and maintains the slidability with the fixing belt 310.

The resistive heat generators 371 to 378 can be formed by, for example, applying a paste prepared by mixing silver-palladium (AgPd), glass powder, or the like to the base 341 by screen printing or the like, and then firing the base 341. In the present embodiment, the resistance value of each of the resistive heat generators 371 to 378 is set to 80Ω at normal temperature (the total resistance value is set to 10Ω).

As the material of the resistive heat generators 371 to 378, a resistance material such as a silver alloy (AgPt) or ruthenium oxide (RuO2) may be used in addition to the materials described above. Silver (Ag), silver palladium (AgPd) or the like may be used as a material of the conductors 370*a* and 370*b* and the electrodes 370*c* and 370*d*. In such a case, screen-printing such a material forms the conductors 370*a* and 370*b* and the electrodes 370*c* and 367*d*.

The resistive heat generators 371 to 378 transfer heat to the fixing belt 310 that contacts the insulation layer 385, raise the temperature of the fixing belt 310, and heats an unfixed toner image on the sheet P conveyed to the fixing nip SN to fix the toner image on the sheet P. Use of the PTC elements as the resistive heat generators 371 to 378 reduces an increase in temperature in the PTC element in which small sheets do not contact when the small sheets pass through the fixing device 300 since the relation of the PTC element between resistance and temperature reduces heat generation amount in the PTC element in which the small sheets do not contact.

For example, when printing is performed on sheets smaller than a width corresponding to all resistive heat generators 371 to 378, for example, sheets having a width smaller than the width corresponding to the resistive heat generators 373 to 376, temperatures in the resistive heat generators 371, 372, 377, and 378 disposed outside the sheets increase since the sheets do not absorb heat from the resistive heat generators 371, 372, 377, and 378. Raising temperatures in the resistive heat generators 371, 372, 377, and 378 that are PTC elements causes increase in resistance values of the resistive heat generators 371, 372, 377, and 378.

Since a constant voltage is applied to the resistive heat generators 371 to 378, the increase in resistance values relatively reduces outputs of the resistive heat generators 371, 372, 377, and 378 disposed outside the width of the sheet, thus restraining an increase in temperature in end portions outside the sheets. If the resistive heat generators 371 to 378 are electrically connected in series, there is no method except a method of reducing a print speed to restrain temperature rises in resistive heat generators 371, 372, 377, and 378 outside the width of the sheets during continuous printing. Electrically connecting the resistive heat generators 371 to 378 in parallel can restrain temperature rises in non-sheet passage portions while maintaining the print speed.

If there are gaps between the resistive heat generators 371 to 378 in the short-side direction, temperature decrease may occur in the gaps, which may cause uneven fixing. Hence, end portions of adjacent ones of the resistive heat generators 371 to 378 in the longitudinal direction overlap as illustrated in FIGS. 5A and 5B.

In FIG. 5A, a step portion formed by an L-shaped notch is formed an end portion of each of the resistive heat generators 371 to 378, and the step portion overlaps with a step portion at an end portion of an adjacent resistive heat generator. In FIG. 5B, an oblique cut-away inclination is formed at each of the end portions of the resistive heat generators 371 to 378 so that the inclination overlaps the inclination of the end portion of the adjacent resistive heat generator. Mutually overlapping the end portions of the resistive heat generators 371 to 378 in this manner can restrain the influence of a decrease in heat generating amount in gaps between the resistive heat generators.

The electrodes 370*c* and 370*d* may be disposed on one side of the resistive heat generators 371 to 378 instead of being disposed on both sides of the resistive heat generators 371 to 378. Disposing the electrodes 370*c* and 370*d* on one side of the resistive heat generators 371 to 378 in this manner reduces the size of the fixing device in the longitudinal direction, which results in space saving. Each of the resistive heat generators 371 to 378 in FIGS. 5A and 5B is made of a strip-shaped planar heat generator. In some embodiments, for example, a plurality of heat generators having a meandering shape with a reduced line width may be electrically connected in parallel in order to obtain a desired output (resistance value).

Figure 6:
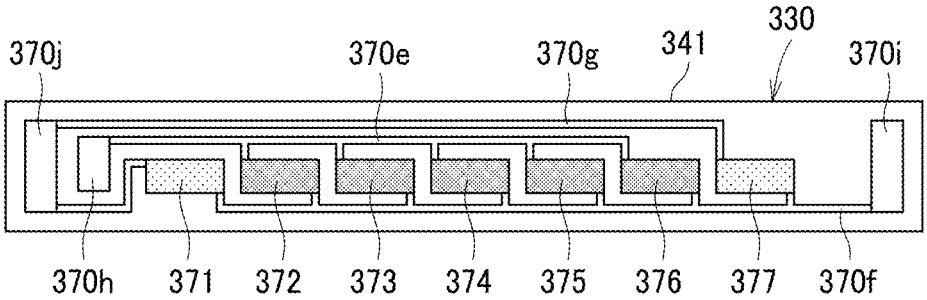
FIG. 6 is a plan view of the heater including heat generators each coupled in parallel to two of three electrodes.

Next, with reference to FIG. 6, the heater 330 according to a modification of the embodiment is described.

Figure 7A:
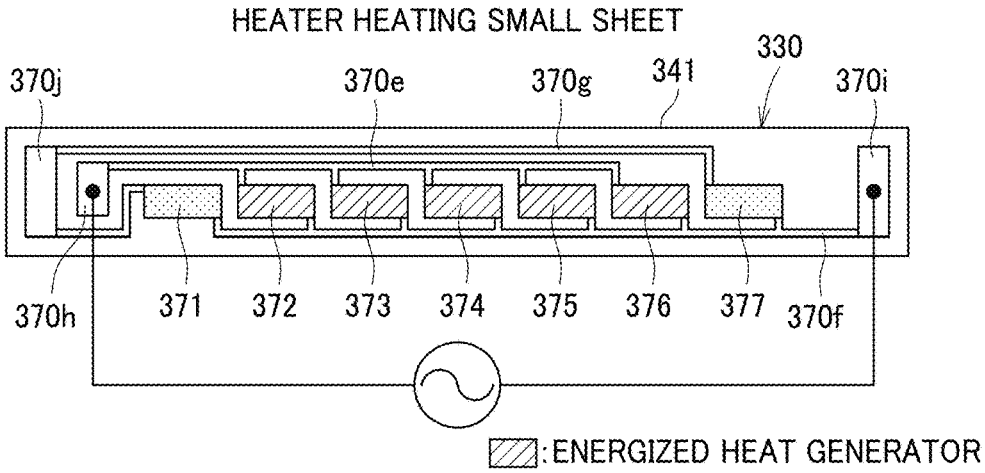
FIGS. 7A to 7C are plan views of the heaters including resistive heat generators that are energized to generate heat in various conditions.
Figure 7B:
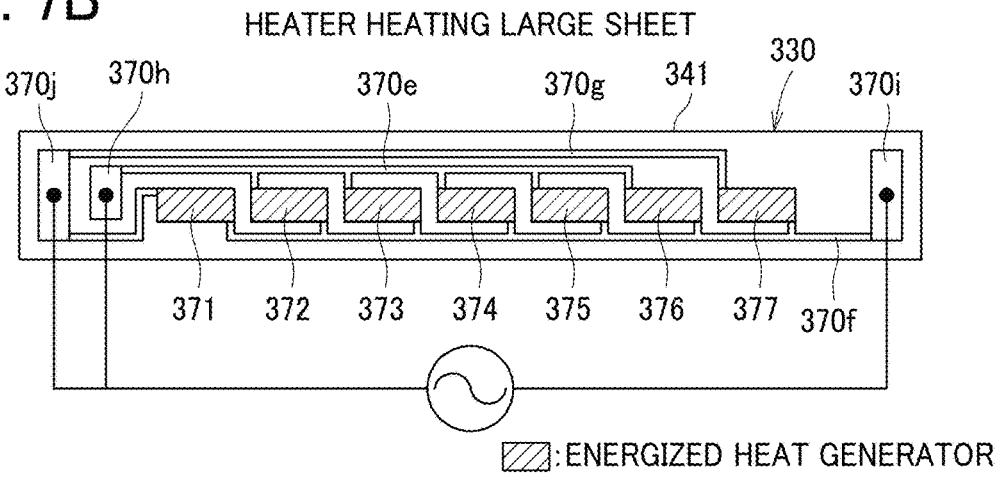
Figure 7C:
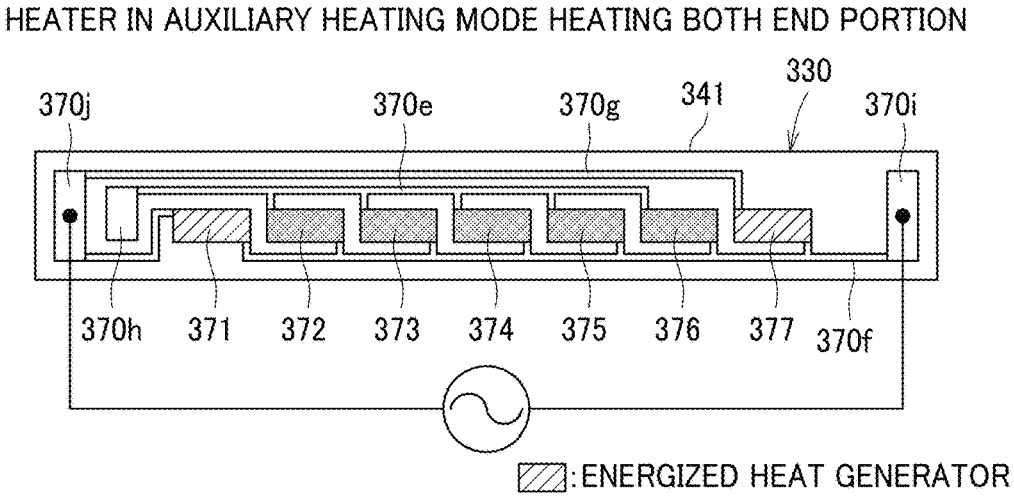

The heater 330 according to the modification includes three electrodes 370*h*, 370*i*, and 370*j* disposed at both ends of the base 341, and seven resistive heat generators 371 to 377 disposed between the electrodes in the longitudinal direction of the base 341. The heater 330 can generate heat in three heat generation patterns as illustrated in FIGS. 7A to 7C that are selected as described below.

Five resistive heat generators 372 to 376 at a center portion in the longitudinal direction of the heater 330 are coupled in parallel to a first electrode 370*h* and a second electrode 370*i* via conductors 370*e* and 370*f* having lower resistance than the resistive heat generators. Two resistive heat generators 371 and 377 at both end portions in the longitudinal direction are coupled in parallel to the second electrode 370*i* and a third electrode 370*j* via conductors 370*f* and 370*g* having lower resistance than the resistive heat generators 371 and 377.

The five resistive heat generators 372 to 376 at the center portion in the longitudinal direction are referred to as first resistive heat generators. The two resistive heat generators 371 and 377 at the both end portions in the longitudinal direction are referred to as second resistive heat generators. The conductors 370*e* and 370*f* coupling to the first resistive heat generators are referred to as first conductors. The conductors 370*f* and 370*g* coupling to the second resistive heat generators are referred to as second conductors.

The second electrode 370*i* on a right end portion of the heater 330 is always connected to an AC power source, and the first electrode 370*h* and the third electrode 370*j* on a left end portion of the heater 330 are selectively connected to the AC power source by switching of switches. Thus, three heat generation patterns illustrated in FIGS. 7A to 7C can be selected.

In the above-described heater 330 having the three heat generation patterns that can be selected, for example, a length in the longitudinal direction of the five resistive heat generators 372 to 376 that are continuously arranged at the center portion in the longitudinal direction of the heater 330 is set to be a width of A4 size sheet, and a length of all seven the resistive heat generators 371 to 377 including the resistive heat generators at both end portions is set to be a width of A3 size sheet. The controller appropriately selects one of the heat generation patterns as illustrated in FIGS. 7A and 7B based on the size of the sheet printed to uniformly heat the sheet. In the heat generation pattern illustrated in FIG. 7A, the controller energizes the seven resistive heat generators corresponding to A4 size, and the heater 330 uniformly heats a small sheet that has A4 size or smaller size than A4 size. In the heat generation pattern illustrated in FIG. 7B, the controller energizes the all resistive heat generators corresponding to A3 size, and the heater 330 uniformly heats a large sheet that has a size larger than A4 size such as A3 size.

In the heat generation pattern as illustrated in FIG. 7B, temperatures at both end portions of the heater 330 tend to decrease because heat generated by each of resistive heat generators 371 and 377 at both end portions transfers to the end of the heater 330 and outside the heater 330. In addition to the heat generation pattern as illustrated in FIG. 7B, the controller performs the heat generation pattern as illustrated in FIG. 7C so that the heater 330 uniformly heats the sheet in the longitudinal direction. In FIG. 7C, a voltage is applied only to the second electrode 370*i* and the third electrode 370*j*, and a current flows only to the resistive heat generators 371 and 377 at both end portions through the conductors 370*f* and 370*g*. As a result, only the resistive heat generators 371 and 377 generate heat.

A heat generation control method for the resistive heat generators 371 to 377 is generally a duty cycle method in which the controller changes a duty cycle that is a ratio of time turning on the resistive heat generators to a predetermined time to get a suitable heat generation amount. The duty cycle is adjusted by controlling the phase of the AC power source by a triac as a control means. The current is zero at a 0% duty cycle and is a maximum value at a 100% duty cycle. The heat generation pattern as illustrated in FIG. 7C occurs instantaneously and intermittently in the above-described duty cycle control.

The following describes increase in a heat generation amount of the conductor that is caused by decreasing the size of the heater.

Recent speeding up printing in the image forming apparatus needs the resistive heat generators 371 to 377 in the heater 330 generating larger heat amounts. Combining the Ohm's law and the Joule's law gives a relation between a heat generation amount W [J/sec], a voltage V [v], and a resistance R [Ω], that is, W=V2/R (which is referred to as equation A).

Equation A means that decreasing the resistance of the heat generator increases the heat generation amount. Further, when the voltage is constant (for example, 100V), decreasing the resistance causes increase in current.

On the other hand, reducing the size of the image forming apparatus requests reducing the diameter of the fixing belt that needs reducing the dimension of the heater in the short-side direction. The dimension of the heater 330 in the short-side direction is the sum of 1) the dimension of each of the resistive heat generators 371 to 377, 2) the dimension of each of the conductors 370*e* to 370*g*, and 3) the dimension of the remaining region that is the region of the base 341 on which nothing is disposed. Hereinafter, a method of reducing 1) to 3) is examined.

1) Reducing the dimension of the resistive heat generator in the short-side direction results in a large heating density. The large heating density means a large temperature peak and a sharp temperature distribution in the short-side direction of the heater. The above causes difficulty in transferring heat from the heater to the fixing belt, a temperature higher than the heat resistance temperature of a member on the back side of the heater such as the heater holder or the thermistor), or increasing probability of malfunction of a thermostat or fuse that detects excessive temperature rise of the heater and cuts off power supply to the heater. As a result, reducing the dimension of the resistive heat generator in the short-side direction has a limit.

2) Reducing the dimension of the conductor, that is, reducing the width of the conductor decreases the cross-sectional area of the conductor, which increases the resistance value of the conductor. Reducing the width of the conductor and increasing the thickness of the conductor maintains the cross-sectional area to some extent and prevents the resistance value from increasing, but screen-printing method has a limit in increasing the thickness.

3) The remaining region on which the resistive heat generators and the conductors do not exist requires a predetermined distance to ensure insulation between the conductors, the resistive heat generators, and peripheral components. As a result, a practical solution to reduce the size of the heater, that is, reduce the dimension of the heater in the short-side direction is to reduce the width of the conductor and to use the conductor having increased resistance as a part of the heater.

Increasing a current flowing the conductor and increasing the resistance of the conductor increases the heat generation amount W of the conductor in an accelerated manner. This can be easily understood by expressing the heat generation amount W [J/sec] in the conductor as W=I2R (which is referred to as Equation B) that is a modification of Equation A (I: current [A], R: resistance [Ω]).

In Equation B, the heat generation amount W of the conductor is proportional to the square of the conductor current and the first power of the conductor resistance. This means that the heat generation amount W of the conductor cannot be ignored. The above-described Equation A to calculate the heat generation amount W of the conductor includes the voltage V that takes time and effort to measure when the voltage V is applied to the conductor connected to the resistive heat generator in series. For this reason, the heat generation amount W of the conductor is calculated by using not the Equation A but the Equation B.

Increasing the resistance of the conductor and reducing the resistance of the resistive heat generator means that the resistance value of the conductor relatively approaches the resistance value of the resistive heat generator. When a voltage was applied to the heater 330 having the relation between resistance values as described above and as illustrated in FIG. 7A to heat the A4 sheet, an unexpected shunt current was generated as indicated by white arrows in FIG. 8A.

Figure 8A:
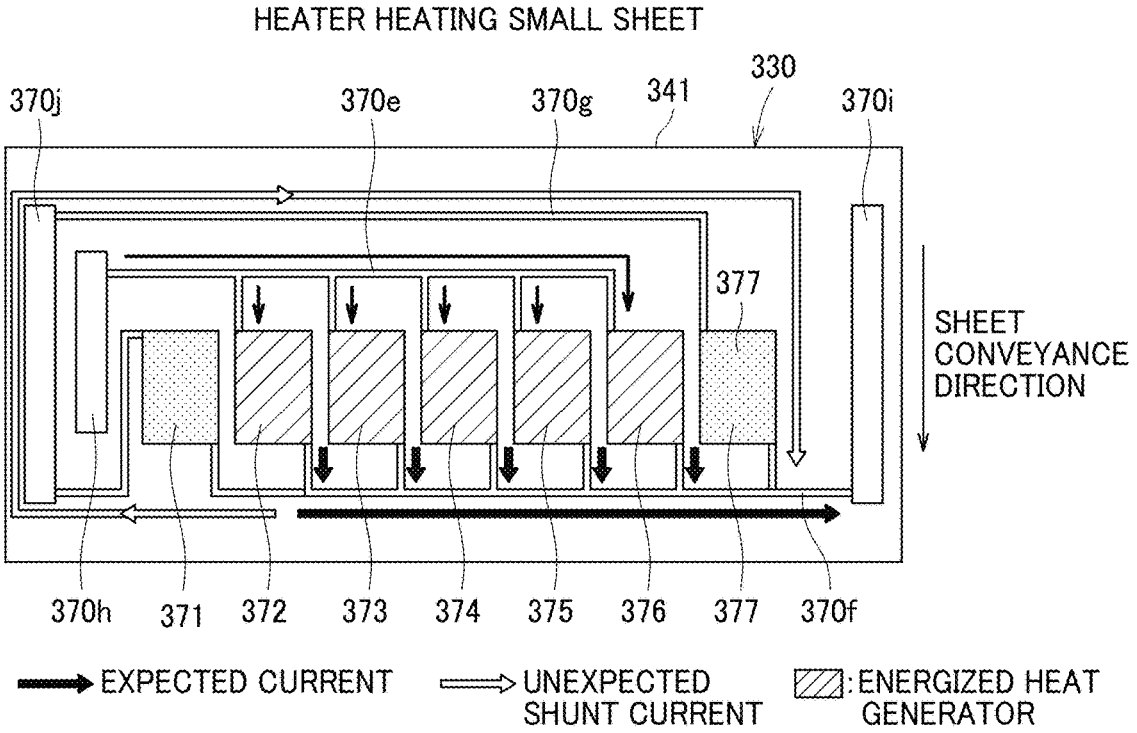
FIG. 8A is a plan view of the heater illustrating currents when the resistive heat generators at a center portion are energized to generate heat.

In other words, reducing the resistance of the resistive heat generator causes the resistive heat generator to flow a current similar to the conductor. In FIG. 8A, an AC power supply is connected to the electrodes 370*h* and 370*i*, but for the sake of convenience, arrows indicates a current flow when a current flows from the left electrode 370*h* to the right electrode 370*i*.

Asymmetrical heat generation amount distribution in the longitudinal direction occurs in the heater as illustrated in FIG. 8A as described below.

Figure 8B:
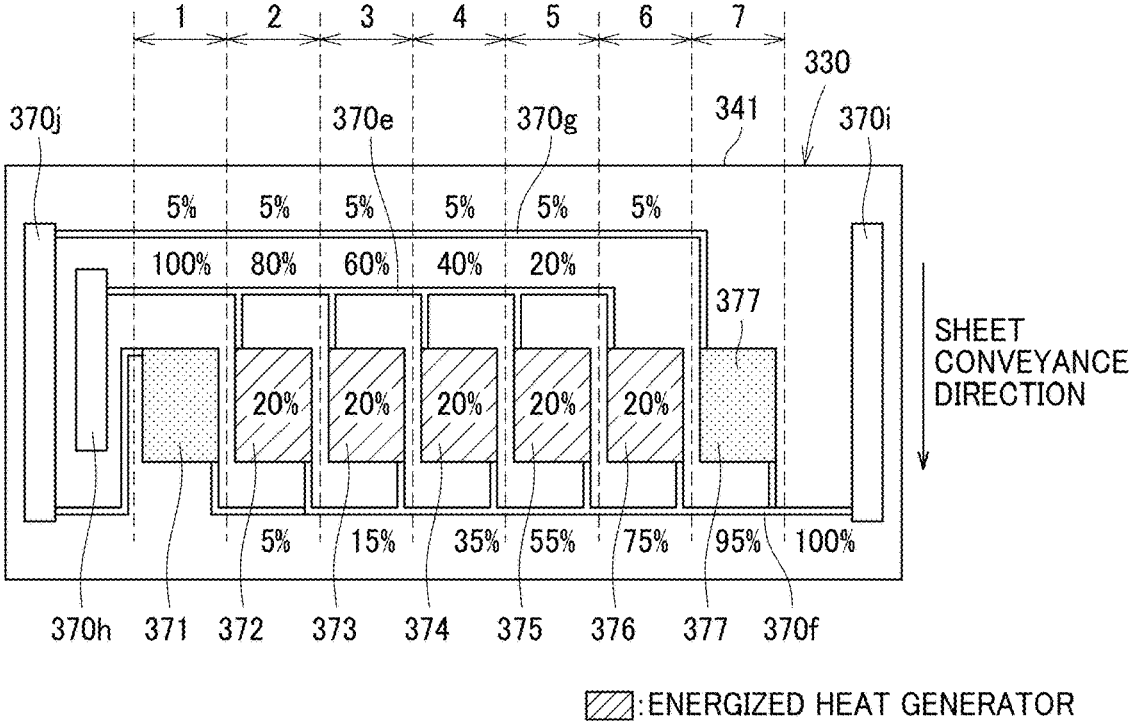
FIG. 8B is a plan view of the heater illustrating ratios of currents flowing through resistive heat generators and conductors illustrated in FIG. 8A.

The heater 330 in which the unexpected shunt current is generated as illustrated in FIG. 8A is divided into seven blocks in the longitudinal direction in accordance with positions of the resistive heat generators, that is, a first block to a seventh block as illustrated in FIG. 8B to estimate heat generation amounts in the blocks generated by the conductors 370*e* to 370*g*. From the first electrode 370*h* on the left end portion of the heater 330, 100% of current flows. The current is divided by 20% to each of the resistive heat generators 372 to 376 each having the same resistance value.

As a result, in the conductor 370*e* upstream in the sheet conveyance direction from the resistive heat generators 372 to 375, the current splits into each of the blocks, and 80%, 60%, 40%, and 20% of the current flow the second block to sixth block, respectively. Subsequently, 20% of the current flows downstream in the sheet conveyance direction and passes through each of the resistive heat generators 372 to 376.

At a point downstream from the resistive heat generator 372, not all of the 20% of the current flows to the right (that is, to the second electrode 370*i*). As indicated by white arrows in FIG. 8A, a part of the current is diverted to the left (that is, to the third electrode 370*j*). For example, after the 20% of the current flows through the resistive heat generator 372, 15% of the current flows to the right, and 5% of the current flows to the left. Then, at the point downstream from the resistive heat generator 372, 5% of the current flows to the left, and 15% of the current flows to the right in the longitudinal direction. In addition, at points downstream from the resistive heat generators 373 to 375, 35%, 55%, and 75% of the current flow to the left in the longitudinal direction, respectively.

The 5% of the current diverted to the left from the point downstream from the resistive heat generator 372 flows through the resistive heat generator 372→the conductor 370*f*→the resistive heat generator 371→the third electrode 370*j*, and then flows back through the third electrode 370*j*→the conductor 370*g*. Since the conductor 370*g* does not have a fork, the magnitude of the current flowing back through the conductor 370*g* remains unchanged at 5%, and the 5% of the current generates heat in all of the first to sixth block. The following describes a heat generation amount generated by the conductors 370*e* to 370*g* in each of the second to sixth block.

The heat generation amount is expressed by the Equation B, that is, W=I2R. If the conductors 370*e* to 370*g* extending in the longitudinal direction are made of the same material and have the same length and the same cross-sectional area in each block, resistance values of the conductors 370*e* to 370*g* are the same in each block, that is, the resistances R in the above equation are equal in the second to sixth block. Accordingly, calculating the sum of the squares of the currents flowing through the conductors 370*e* to 370*g* in each block enables a relative comparison of the heat generation amounts in the second to sixth block.

The heat generation amount generated by the conductors 370*e* to 370*g* in the second block is expressed as 5% 2+80% 2+5% 2=6450. Similarly, the heat generation amounts generated by the conductors 370*e* to 370*g* in the third to sixth block are calculated and illustrated in FIG. 8C.

Figure 8C:
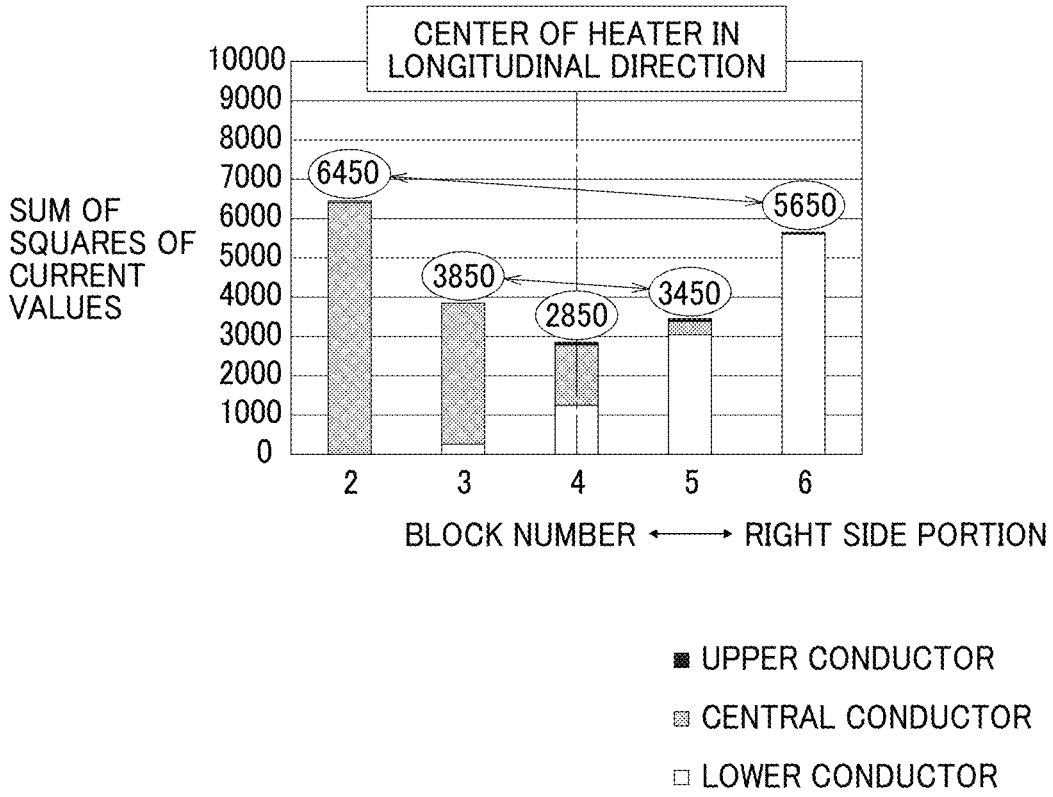
FIG. 8C is a graph illustrating heat generation amounts of the conductors in heat generator blocks that are calculated based on the ratios of currents in FIG. 8B.

The heat generation amounts generated by the conductors 370*e* to 370*g* in the second to sixth block are asymmetrical in the longitudinal direction with reference to the fourth block that is the center block in the longitudinal direction of the resistive heat generators 371 to 377 (or 372 to 376). In FIG. 8C, an upper conductor, a central conductor, and a lower conductor mean the conductors 370*g*, 370*e*, and 370*f*, respectively. In the graph of FIG. 8C, the upper, central, and lower conductors illustrate the heat generations amounts arranged in the sheet conveyance direction. In FIG. 8C, a right side portion means a portion from the center of the resistive heat generators 371 to 377 in the longitudinal direction to the second electrode 370*i*.

An asymmetrical heat generation amount distribution in the longitudinal direction causes a symmetrical temperature distribution of the fixing belt 310 that contacts the heater 330 to heat the sheet. The asymmetrical temperature distribution of the fixing belt 310 causes an image failure called gloss unevenness, or gloss level difference. The asymmetrical temperature distribution, that is, the image failure becomes strongly apparent when A4 size sheets are continuously printed for a long time, and when the central five blocks, that is, the second block to the sixth block generate heat for a long time.

According to results of experiments, the asymmetrical temperature distribution, that is, the image failure was likely to be caused when the dimension of the resistive heat generators 371 to 377 in the short-side direction is 25% or more with respect to the dimension of the base 341 of the heater 330 in the short-side direction. In addition, the asymmetric temperature distribution that is, the image failure becomes more strongly apparent when the dimension of the resistive heat generators 371 to 377 in the short-side direction is 40% or more with respect to the dimension of the base 341 of the heater 330 in the short-side direction.

The following describes a heat generation amount distribution when A3 size sheets are continuously printed.

Figure 9A:
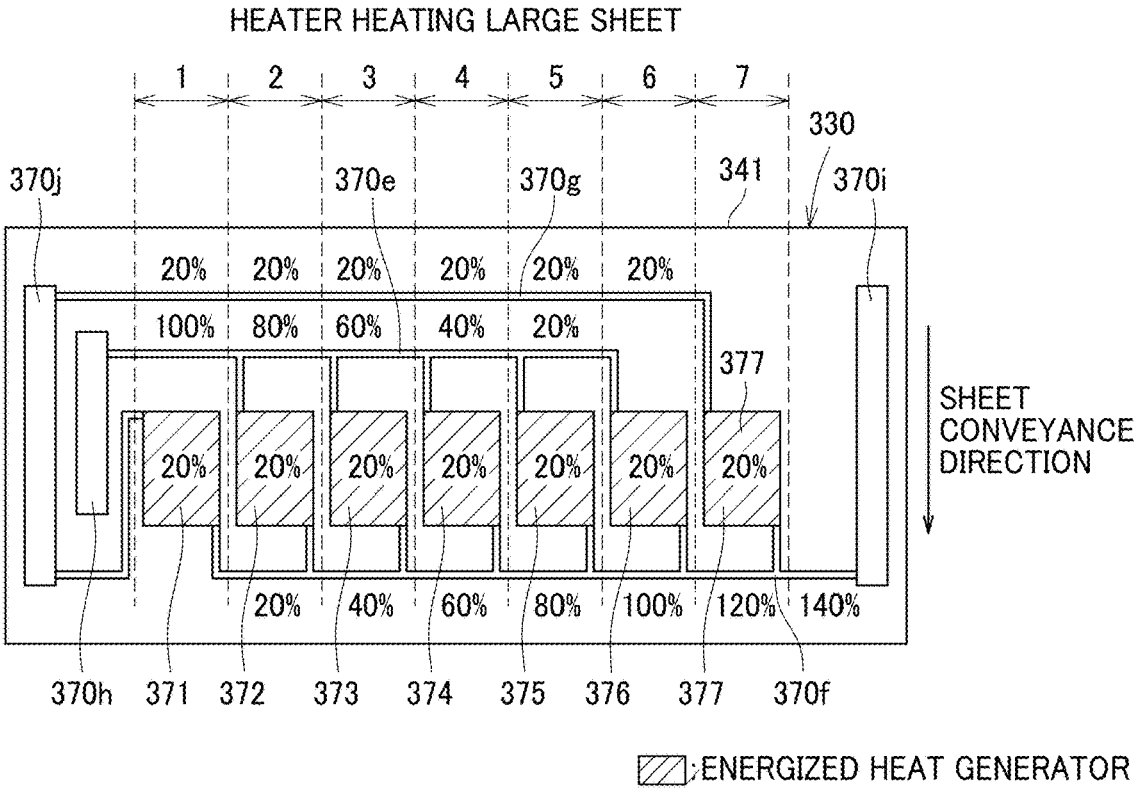
FIG. 9A is a plan view of the heater illustrating ratios of currents flowing through resistive heat generators and conductors when all resistive heat generators are energized to generate heat.

Using the above-described method estimates heat generation amounts generated by the conductors 370*e* to 370*g* when a voltage is applied to the heater as illustrated in FIG. 7B to heat the A3 size sheets. FIG. 9A illustrates the results. It is assumed that the resistive heat generators in all the blocks, that is, the first to the seventh block have the same resistance value, and AC 100V is applied between the electrodes 370*i* and 370*h* and between the electrodes 370*i* and 370*j*. A current having the same current value as in the FIG. 8B, that is, 20% of the current flows through each of the resistive heat generators 371 to 377.

In the heater illustrated in FIG. 9A, the unexpected shunt current (that is, the current diverted as indicated by the white arrows in FIG. 8A) does not occur, and a current flows from the left end to the right end of the lower conductor, that is, the conductor 370*f*. The AC power supply is connected between the electrodes 370*h* and 370*i* and between the electrodes 370*j* and 370*i*, but for the sake of convenience, it is assumed that the current flows from the left electrodes 370*h* and 370*j* to the right electrode 370*i*.

Figure 9B:
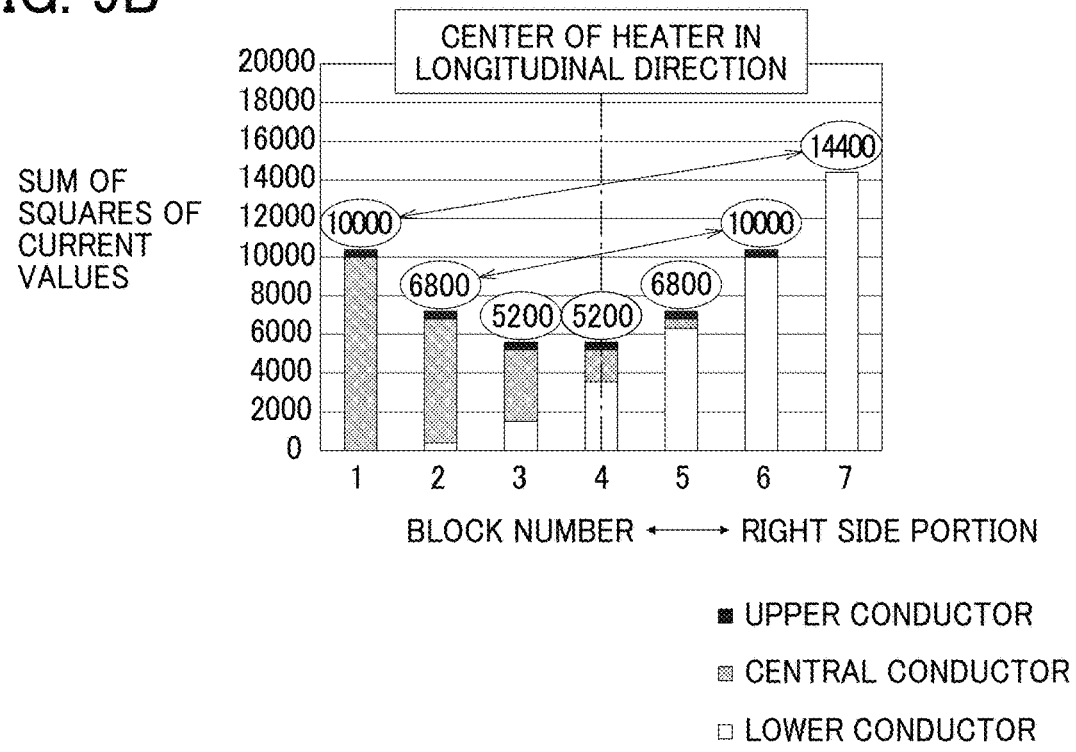
FIG. 9B is a graph illustrating heat generation amounts of the conductors in the heat generator blocks that are calculated based on the ratios of currents in FIG. 9A.

Heat generation amounts generated by the conductors 370*e* to 370*g* in the blocks are calculated as sums of squares of currents flowing through the conductors. As a result, the heat generation amount distribution was asymmetric in the longitudinal direction as illustrated in FIG. 9B, and the heat generation amount in the right side portion is higher than the heat generation amount in the left side portion. That is, the asymmetrical distribution in FIG. 9B when the A3 size sheets are heated is different from the asymmetrical distribution in FIG. 8A when the A4 size sheets are heated.

The larger current in FIG. 9B than the current in FIG. 8C increases an absolute value and a ratio in the difference in the asymmetrical heat generation amount distribution generated by the conductors. The asymmetrical temperature distribution of the fixing belt 310, that is, the image failure becomes most strongly apparent when the A3 sheets are heated.

In the above description, the first and seventh block (that is referred to as end blocks) and the second to sixth block (that is referred to as center blocks) have the same longitudinal length and the same resistance value to uniformly heat the A3 size sheet and the A4 size sheet. However, the end blocks and the center blocks may have different lengths to uniformly heat the sheets having different sizes (e.g., A4 and A3). Changing the length of the block causes a change of a resistance value in the block, but the asymmetrical temperature distribution as illustrated in FIGS. 8C and 9B in the longitudinal direction does not change.

Figure 10A:
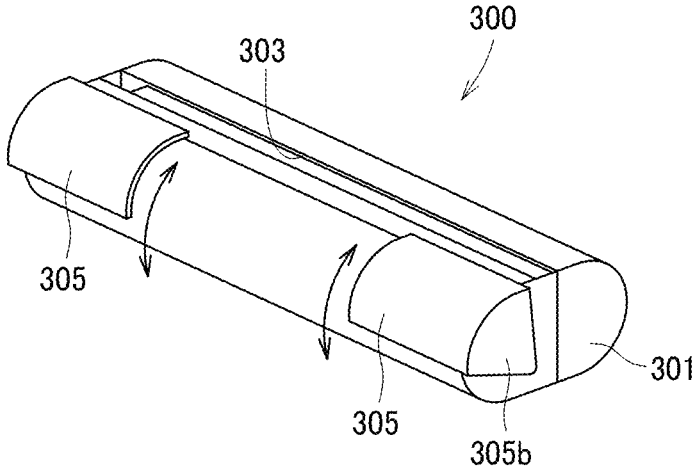
FIG. 10A is a perspective view of the fixing device with shutters disposed on both end portions and independently and separately opened and closed, according to a modification of the embodiment of the present disclosure.

Accordingly, the joint 305*a* may be removed from the pair of left and right shutters 305 as illustrated in FIG. 10A so that the left and right shutters independently move.

The above-described configuration can independently adjust opening degrees of the left and right shutters 305 to uniform the above-described asymmetrical temperature distribution that differs between when the A4 size sheets are heated and when the A3 size sheets are heated.

Figure 10B:
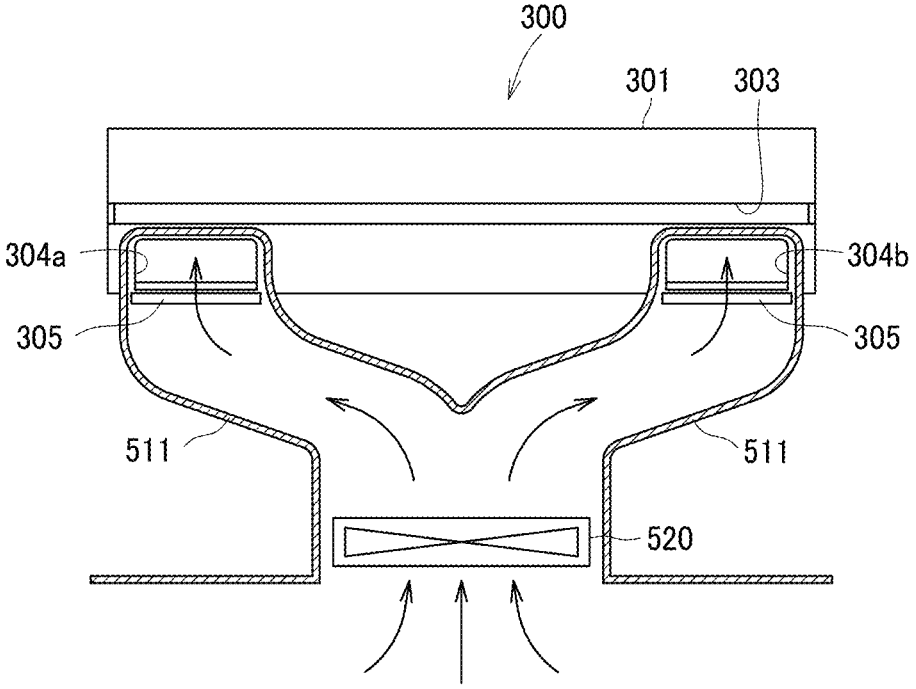
FIG. 10B is a plan view of an air duct coupled to openings in the both end portions of a housing of the fixing device with shutters disposed on the both end portions and independently and separately opened and closed, according to the modification of the embodiment of the present disclosure.

In this case, as illustrated in FIG. 10B, a bifurcated air duct 511 may be coupled to the left and right openings 304*a* and 304*b* of the housing 301 of the fixing device 300. In the above, as long as air flows between the openings 304*a* and 304*b* and the air duct 511", the air duct is coupled to the openings 304*a* and 304*b*. There may be a gap between the air duct 511 and each the openings 304*a* and 304*b*. In addition, the blower fan 520 is disposed on a portion upstream from a bifurcated portion of the air duct 511.

Using the bifurcated air duct 511 as described above can set the number of blower fan 520 to be one. As a result, the size of the image forming apparatus can be reduced. The image forming apparatus may include independent air ducts, that is, a left air duct 511 and a right air duct 511, and the blower fan 520 may be disposed in each of the air ducts. This configuration can increase a wind power in each of the openings 304*a* and 304*b* and improve a cooling performance.

To describe reducing the asymmetrical temperature distribution that differs between when the A4 size sheets are heated and when the A3 size sheets are heated, the left opening 304*a* is referred to as a first opening 304*a*, and the right opening 304*b* is referred to as a second opening 304*b*. The heater 330 is disposed in the housing 301 so that the first opening 304*a* faces one end portion in the longitudinal direction of the heater 330 on which the first electrode 370*h* and the third electrode 370*j* are disposed, that is, the left end portion of the heater 330 illustrated in FIGS. 8A and 8B. In addition, the heater 330 is disposed in the housing 301 so that the second opening 304*b* faces the other end portion in the longitudinal direction of the heater 330 on which the second electrode 370*i* is disposed, that is, the end portion opposite to the above one end portion.

The opening area of the first opening 304*a* is referred to as S1, and the opening area of the second opening 304*b* is referred to as S2. When only the first resistive heat generators 372 to 376 generate heat to heat the A4 size sheet, the controller controls drivers attached to rotation shafts of shutters 305 to rotate the shutters 305 so as to be S1>S2 in order to reduce the temperature difference of the fixing belt 310 caused by the asymmetrical heat generation amount distribution as illustrated in FIG. 8C.

In addition, when both the first resistive heat generators 372 to 376 and the second resistive heat generators 371 and 377 generate heat to heat the A3 size sheet, the controller controls the drivers to rotate the shutters 305 so as to be S1<S2 in order to reduce the temperature difference of the fixing belt 310 caused by the asymmetrical heat generation amount distribution as illustrated in FIG. 9B. The above-described configuration can more effectively prevent the excessive temperature rise at the end portion of the fixing belt 310 when the A4 size sheets or the A3 size sheets are heated and the image failure such as the gross unevenness caused by the asymmetrical heat generation amount distributions as illustrated in FIGS. 8C and 9B.

Although some embodiments of the present disclosure have been described above, embodiments of the present disclosure are not limited to the embodiments described above, and a variety of modifications can be made within the scope of the present disclosure. For example, although the shutter 305 is disposed outside the opening 304 so as to be openable and closable but may be disposed inside the opening 304 so as to be openable and closable.

The heating device of the present disclosure may be used not only for the fixing device 300 described above, but also for a sheet drying device for an inkjet printer. In addition to the PTC element used in the heater 330, other heat generator such as a ceramic heater may be used as the resistive heat generator to heat the fixing belt 310.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. A heating device comprising:

a heating rotator extending in a longitudinal direction to heat a sheet;

a pressing rotator extending in a longitudinal direction to press against the heating rotator to form a nip with the heating rotator; and a housing that houses the heating rotator and the pressing rotator, the housing including:

a pair of openings facing both end portions of the heating rotator in the longitudinal direction of the heating rotator; and shutters to rotate about an axis extending in the longitudinal direction of the heating rotator, the axis is inside a cross-section of the heating rotator orthogonal to the longitudinal direction of the heating rotator, to open and close the pair of openings.

2. The heating device according to claim 1, wherein the shutters each have a curved shape outside an outer circumference of the heating rotator in the cross-section of the heating rotator.

3. The heating device according to claim 1, wherein at least a part of the openings is disposed in an upper portion of the housing when the heating device heats the sheet.

4. The heating device according to claim 1, further comprising:

a heater; and a temperature detector to detect at least a temperature of an end portion of the heater and a temperature of a center portion of the heater in a longitudinal direction of the heater.

5. The heating device according to claim 4, wherein the heater includes a resistive heat generator to heat the heating rotator in response to an application of a voltage.

6. The heating device according to claim 4, wherein the heater includes:

a plurality of first resistive heat generators disposed at a central portion of the heater in the longitudinal direction of the heater, a plurality of second resistive heat generators disposed at both end portions of the heater in the longitudinal direction of the heater, a first electrode disposed at one end portion of the heater in the longitudinal direction of the heater, a second electrode disposed at the other end portion of the heater in the longitudinal direction of the heater, a third electrode disposed at the one end portion of the heater in the longitudinal direction of the heater, a first conductor coupling the first resistive heat generators in parallel between the first electrode and the second electrode, and a second conductor coupling the second resistive heat generators in parallel between the second electrode and the third electrode, wherein the pair of openings include a first opening facing the one end portion of the heater in the longitudinal direction of the heater and having a first opening area and a second opening facing the other end portion of the heater in the longitudinal direction of the heater and having a second opening area, wherein the shutters rotate such that the first opening area is larger than the second opening area when a voltage is applied between the first electrode and the second electrode and is not applied to the third electrode so as to energize the first resistive heat generators and not to energize the second resistive heat generators, and wherein the shutters rotate such that the first opening area is smaller than the second opening area when the voltage is applied between the first electrode and the second electrode and between the second electrode and the third electrode so as to energize the first resistive heat generators and the second resistive heat generators.

7. The heating device according to claim 6, further comprising:

an air duct coupled to the first opening and the second opening; and a blower fan disposed in the air duct.

8. An image forming apparatus comprising:

a fixing device including the heating device according to claim 7, wherein at least a part of the first opening and at least a part of the second opening are disposed at an upper portion of the housing, and the blower fan discharges air in the housing upward when the fixing device heats the sheet.

9. The image forming apparatus according to claim 8, further comprising:

a sheet ejection path to eject the sheet, and a reverse conveyance path to convey the sheet to perform duplex printing, and a branching portion disposed above the housing of the fixing device, the branching portion at which the sheet ejection path and the reverse conveyance path are branched.

10. A fixing device comprising the heating device according to claim 1.

11. An image forming apparatus comprising the fixing device according to claim 10.

* * * * *